US011878884B2

(12) United States Patent
Kuroda

(10) Patent No.: US 11,878,884 B2
(45) Date of Patent: Jan. 23, 2024

(54) DOCUMENT FEED DEVICE, AND IMAGE FORMING DEVICE INCLUDING THE SAME

(71) Applicant: SHARP KABUSHIKI KAISHA, Sakai (JP)

(72) Inventor: Kenji Kuroda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 119 days.

(21) Appl. No.: 17/462,947

(22) Filed: Aug. 31, 2021

(65) Prior Publication Data

US 2022/0089388 A1 Mar. 24, 2022

(30) Foreign Application Priority Data

Sep. 23, 2020 (JP) ..... 2020-158541

(51) Int. Cl.
*B65H 1/04* (2006.01)

(52) U.S. Cl.
CPC ..... *B65H 1/04* (2013.01); *B65H 2403/411* (2013.01); *B65H 2405/114* (2013.01); *B65H 2511/12* (2013.01); *B65H 2801/06* (2013.01)

(58) Field of Classification Search
CPC ..... B65H 1/04; B65H 2403/411; B65H 2405/1113; B65H 2405/11131; B65H 2405/1114; B65H 2405/11141; B65H 2405/114; B65H 2405/1142; B65H 2405/11425; B65H 2405/1144; B65H 2405/12; B65H 2405/141; B65H 2511/12
See application file for complete search history.

(56) References Cited

U.S. PATENT DOCUMENTS

| | | | | |
|---|---|---|---|---|
| 8,976,371 | B2 * | 3/2015 | Fukuma | B65H 1/04 271/145 |
| 2012/0080839 | A1 * | 4/2012 | Akimatsu | B65H 1/04 271/145 |
| 2012/0306149 | A1 * | 12/2012 | Sunohara | B65H 1/266 271/226 |
| 2020/0148492 | A1 * | 5/2020 | Sugita | B65H 5/36 |
| 2020/0307929 | A1 * | 10/2020 | Nishimura | B65H 1/04 |
| 2021/0269264 | A1 * | 9/2021 | Touchstone | B65H 1/04 |

FOREIGN PATENT DOCUMENTS

JP 2012-076829 A 4/2012

* cited by examiner

*Primary Examiner* — Prasad V Gokhale
(74) *Attorney, Agent, or Firm* — ScienBiziP, P.C.

(57) ABSTRACT

A document feed device including a document tray and a document guide. The document guide has a document guide side document loader and a document guide member. The document tray includes a groove. The document guide, at an end of the document guide side document loader in the width direction, includes: a scooper, and an upstream outline portion that is formed so as to gradually approach the document guide member toward an upstream side in the conveying direction with the scooper as an apex.

4 Claims, 28 Drawing Sheets

DOCUMENT FEED DEVICE, AND IMAGE FORMING DEVICE INCLUDING THE SAME

BACKGROUND OF THE INVENTION

Field of the Invention

The present invention relates to a document feed device, and an image forming device including the same, such as a copier, a multifunction machine, and a facsimile device.

Description of the Background Art

A document feed device is generally provided with a document tray for loading a document and a document guide for guiding an end side of the document on at least one side (either one side or both sides) in a width direction orthogonal to a conveying direction of the document loaded on the document tray. The document guide is often provided with a document guide side document loader having a document loading face on which the document is loaded, and a document guide member that stands from the document guide side document loader and guides the end side of the document.

In this type of document feed device, there is no particular inconvenience when the document is loaded on the document tray after the document guide is adjusted to the size of the document, because the document can always be loaded on the document loading face in the document guide side document loader. However, when the document is first loaded on the document tray and then the document guide is adjusted to the size of the document, the following inconvenience will occur.

That is, the document may be loaded inside the document guide side document loader while the document guide side document loader is opened outside the size of the document. In this case, when the document guide is moved to the document side, the end side of the document may enter the lower side of the document guide side document loader, and if so, the document may be damaged. This becomes more pronounced as the number of sheets loaded on the document tray becomes larger. Further, in recent years, the width of the document guide side document loader has become smaller due to a longer travel distance in the width direction from the maximum size to the smallest size of the document guide in order to accommodate multiple sizes (e.g., small size documents such as business cards), which increases the above risk.

With respect to this point, Japanese Unexamined Patent Application Publication No. 2012-76829 describes a configuration in which a document tray is provided with a groove extending along a width direction for reciprocating movement of a document guide in the width direction, and a scooper is provided at an end portion in the width direction of the document guide side document loader to scoop up an end side of the document when the document guide is moved toward the document loaded on the document tray (see FIG. 3A of Japanese Unexamined Patent Application Publication No. 2012-76829).

In detail, in the configuration described in Japanese Unexamined Patent Application Publication No. 2012-76829, a linear outline portion formed in a linear line along a conveying direction of the document is provided at the end portion in the document guide side document loader where the scooper is provided.

Accordingly, in the configuration described in Japanese Unexamined Patent Application Publication No. 2012-76829, when the document is loaded on the document tray with the document guide side document loader opened outside the size of the document, even if the end side of the document is scooped up by the scooper before the document guide side document loader when the document guide is moved to the document side, the end side of the document easily becomes likely to be along the linear outline portion because the end side in the document guide side document loader where the scooper is installed is provided with the linear outline portion. With this, even when the end side of the document is scooped up by the scooper, the end side of the document may enter the lower side of the linear outline portion in the document guide side document loader, then, the document may be damaged and injured.

Therefore, it is an object of the present invention to provide a document feed device that can effectively prevent an end side of the document from entering the lower side of the document guide side document loader when the document guide is moved to the document side, even if the document is loaded on the document tray in a state where the document guide side document loader is opened more than the size of the document.

SUMMARY OF THE INVENTION

For solving the above problem, a document feed device according to the present invention, includes: a document tray that loads a document; and a document guide that guides an end side of the document on at least one side of the document in a width direction orthogonal to a conveying direction of the document loaded on the document tray, wherein the document guide includes: a document guide side document loader that has a document loading face on which the document is loaded, and a document guide member that stands from the document guide side document loader and guides the end side of the document, the document tray includes a groove that extends along the width direction for a reciprocating movement of the document guide in the width direction, and the document guide, at an end of the document guide side document loader in the width direction, includes: a scooper that scoops up the end side of the document when the document guide is moved toward the document loaded on the document tray, and an upstream outline portion that is formed so as to gradually approach the document guide member toward an upstream side in the conveying direction with the scooper as an apex. In addition, an image forming device according to the present invention includes the document feed device according to the present invention.

According to the present invention, even when the document is loaded on the document tray in a state where the document guide side document loader is more opened than the size of the document, it is possible to effectively prevent the end side of the document from entering the lower side of the document guide side document loader when the document guide is moved to the document side.

DESCRIPTION OF THE PREFERRED EMBODIMENTS

Figure 1:
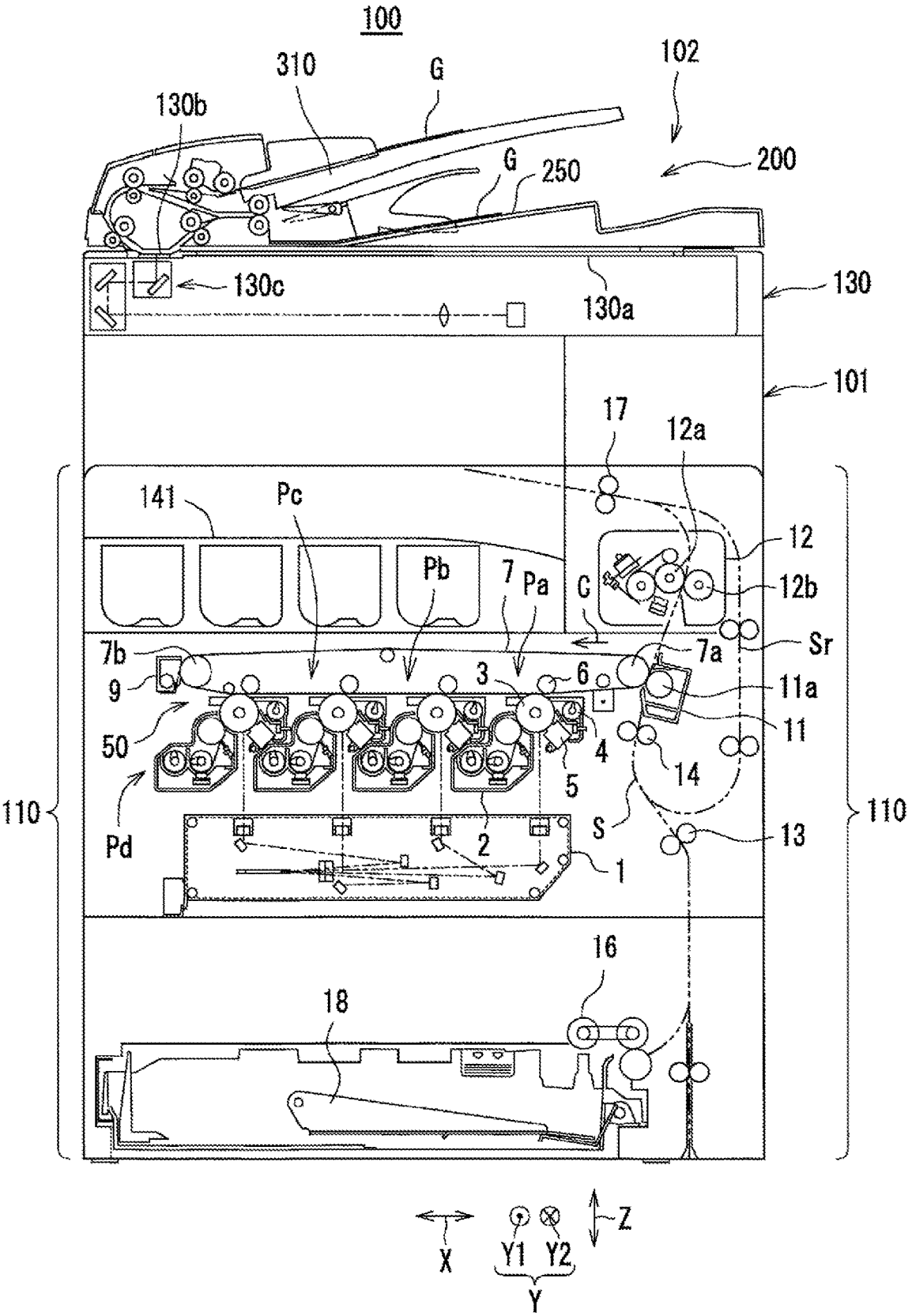
FIG. 1 is a front view showing a schematic configuration of an image forming device in perspective according to the present embodiment.

Hereinafter, embodiments according to the present invention will be described with reference to the drawings. In the following description, the same parts are designated by the same reference numerals. The names and functions of these parts are the same. Therefore, the detailed description of these parts will not be repeated.

Image forming device FIG. 1 is a front view showing a schematic configuration of an image forming device 100 in perspective. In FIG. 1, a sign X indicates the left-right direction, a sign Y1 indicates one side of a front-back direction Y (the side operated by an operator), a sign Y2 indicates the other side of the front-back direction Y (the opposite side of the operation side), and a sign Z indicates an up-down direction.

The image forming device 100 is a multifunction machine having a copy function, a scanner function, a facsimile function, and a printer function, and transmits, to an external portion, an image of the document G read by an image reading device 102. In color or monochrome, the image forming device 100 forms, on paper (recording material), an image of the document G read by the image reading device 102 or an image received from an external portion. The image forming device 100 may be one that forms a monochrome image.

The image reading device 102 is provided with a document feed device 200. The document feed device 200 is provided on the upper side of an image reading portion 130 and is freely supported to open and close relative to the image reading portion 130. The document feed device 200 conveys a single document G or sequentially conveys a plurality of documents G one by one. The image reading device 102 reads the single document G conveyed by or the plurality of documents G sequentially conveyed one by one by the document feed device 200. The image reading device 102 is provided with a document loading table 130*a* (document table) on which the document G is loaded, and a loaded document reading function that reads the document G loaded on the document loading table 130*a*. In the image forming device 100, when the document feed device 200 is opened, the document loading table 130*a* above the image reading portion 130 is opened so that the document G can be loaded by hand. The document feed device 200 is also provided with a document tray 310 on which the document G is loaded and a document discharge tray 250 on which the document G externally discharged is loaded. The image reading device 102 is provided with a conveyed document reading function that reads the document G conveyed by the document feed device 200. Onto a document reading portion 130*b* in the image reading portion 130, the document feed device 200 conveys the document G loaded on the document tray 310. By scanning a scanning optical system 130*c*, the image reading portion 130 reads a document loaded on the document loading table 130*a* or reads the document G conveyed by the document feed device 200, and thereby generates the image data.

The image forming device 100 is provided with an image forming portion 110. The image forming portion 110 is provided with an optical scanning device 1, a developing device 2, a photoconductor drum 3, a drum cleaning device 4, a charger 5, an intermediate transfer belt 7, a fixing device 12, a paper conveyance path S, a paper feed cassette 18, and a paper discharge tray 141 (an in-body discharge tray).

The image forming portion 110 handles image data according to a color image using black (K), cyan (C), magenta (M), and yellow (Y) colors, or a monochrome image using a single color (e.g., black). In an image transfer portion 50 of the image forming device 100, the developing devices 2, the photoconductor drums 3, the drum cleaning devices 4, and the chargers 5, four each, for forming four types of toner images are provided, each of which corresponds to black, cyan, magenta, and yellow, thereby configuring four image stations Pa, Pb, Pc, and Pd.

The optical scanning device 1 exposes the surface of the photoconductor drum 3 thereby to form an electrostatic latent image. The developing device 2 develops the electrostatic latent image on the surface of the photoconductor drum 3 thereby to form a toner image on the surface of the photoconductor drum 3. The drum cleaning device 4 removes and collects a residual toner on the surface of the photoconductor drum 3. The charger 5 uniformly charges the surface of the photoconductor drum 3 to a predetermined potential. Through the series of operations described above, a toner image of each color is formed on the surface of one of the photoconductor drums 3.

On the upper side of the photoconductor drum 3, an intermediate transfer roller 6 is disposed via the intermediate transfer belt 7. The intermediate transfer belt 7 is stretched by a transfer drive roller 7*a* and a transfer driven roller 7*b*, and moves rotationally in the direction of arrow mark C. In the image forming device 100, the residual toner is removed and collected by a belt cleaning device 9, and the toner images of respective colors formed on the surfaces of respective photoconductor drums 3 are sequentially transferred and superimposed thereby to form the color toner image on the surface of the intermediate transfer belt 7.

A transfer roller 11*a* of the secondary transfer portion 11 has a nip area formed between the transfer roller 11*a* and the intermediate transfer belt 7, and, by sandwiching the paper in the nip area, conveys the paper conveyed through the paper conveyance path S. When the paper passes through the nip area, the toner image on the surface of the intermediate transfer belt 7 is transferred and conveyed to the fixing device 12.

The fixing device 12 is provided with a fixing roller 12*a* and a pressurizing roller 12*b* which rotate while sandwiching the paper. The fixing device 12 sandwiches, between the fixing roller 12*a* and the pressurizing roller 12*b*, the paper on which the toner image has been transferred, heats and pressurizes the paper, and fixes the toner image to the paper.

The paper feed cassette 18 is a cassette for accumulating paper to be used for image formation, and is provided on the lower side of the optical scanning device 1. The paper is pulled out of the paper feed cassette 18 by a paper pickup roller 16 and is conveyed to the paper conveyance path S. The paper conveyed in the paper conveyance path S is conveyed through the secondary transfer portion 11 and the fixing device 12 to a discharge roller 17 and discharged to the paper discharge tray 141. A conveyer roller 13, a resistance roller 14, and the discharge roller 17 are disposed in the paper conveyance path S. The conveyer roller 13 promotes the conveyance of the paper. The resistance roller 14 once stops the paper, and aligns the tip end of the paper. The resistance roller 14 conveys the paper, which is once stopped, in timing with a color toner image on the intermediate transfer belt 7. The color toner image on the intermediate transfer belt 7 is transferred to the paper in the nip area between the intermediate transfer belt 7 and the transfer roller 11*a*.

Although the paper feed cassette 18 one in number is provided in FIG. 1, but not limited thereto, and a configuration may be such that a plurality of paper feed cassettes 18 are provided thereby to respectively store different types of paper.

When the image forming device 100 performs image formation on the back face as well as the front surface of the paper, the paper is conveyed in the reverse direction from the discharge roller 17 to a paper reverse path Sr. The image forming device 100 reverses the front and back of the paper conveyed in the reverse direction and leads the conveyed paper again to the resistance roller 14. The image forming device 100, in the same manner as the front surface, also forms an image on the back face of the paper guided by the resistance roller 14, and carries the paper out to the paper discharge tray 141.

The image reading portion 130 is provided on the upper face of an image forming device main body 101. The document feed device 200 is mounted on the image reading portion 130.

Document Feed Device

First Embodiment

Figure 2A:
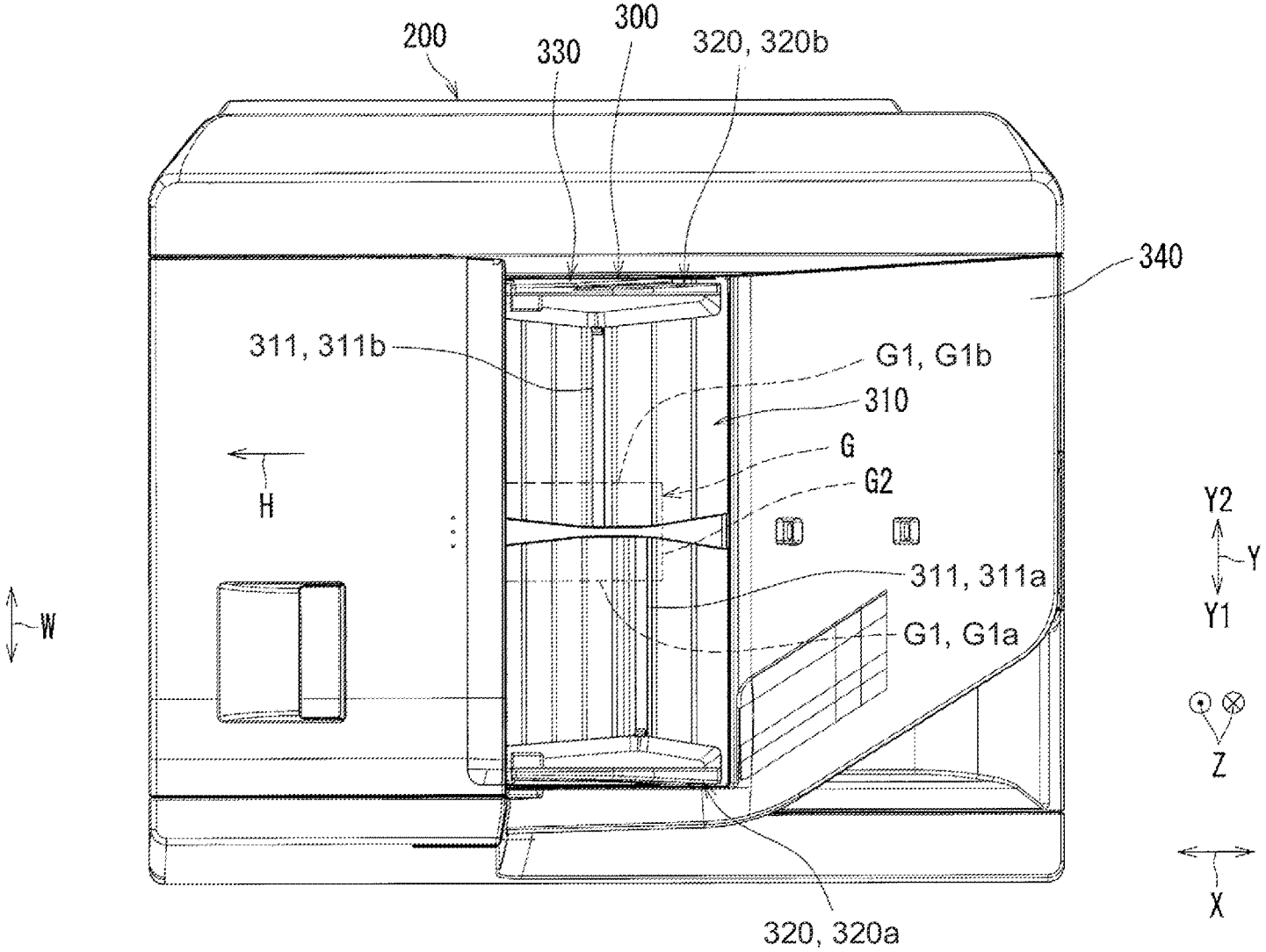
FIG. 2A is a plan view of the document feed device shown in FIG. 1.
Figure 2B:
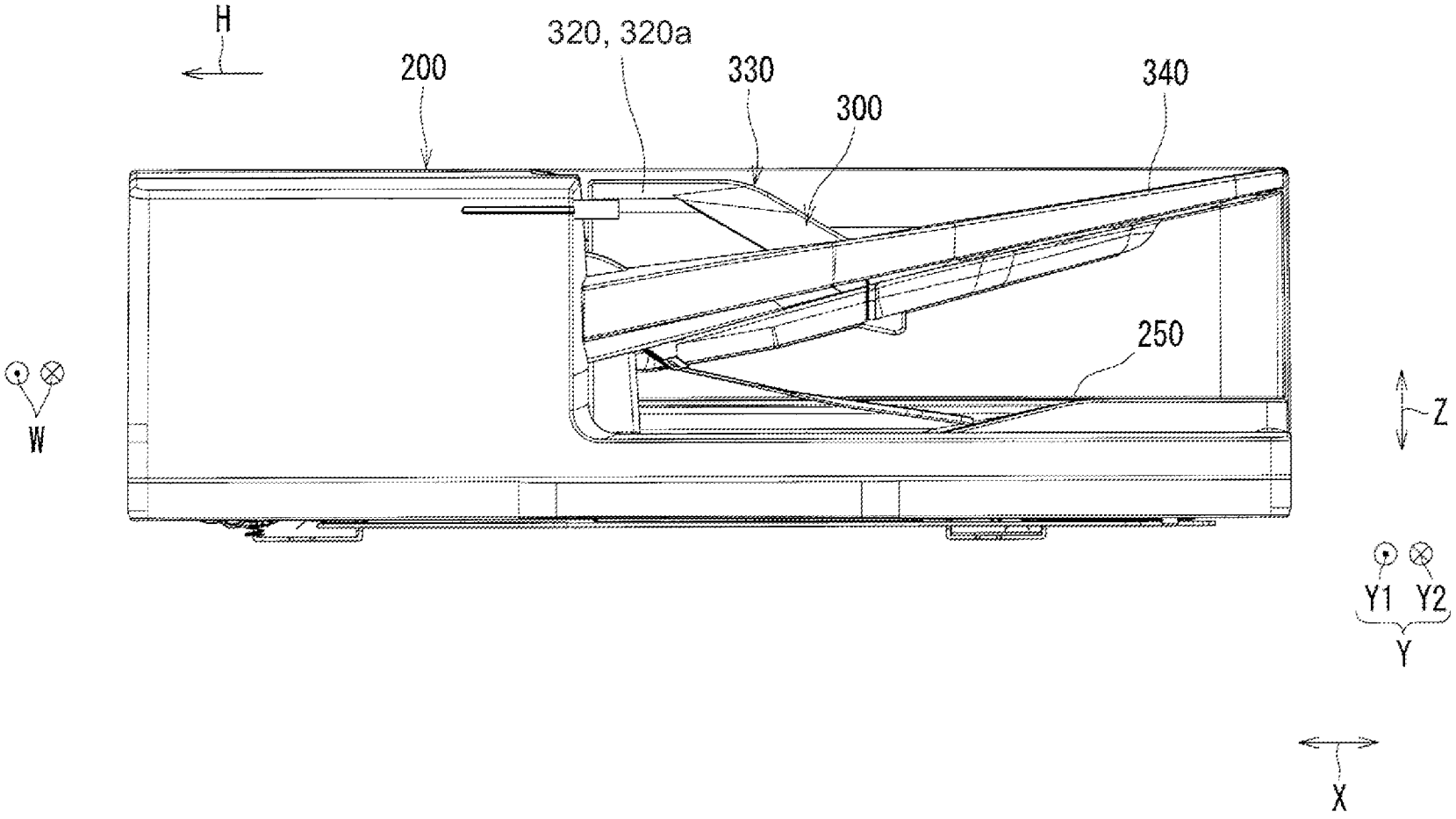
FIG. 2B a front view of the document feed device shown in FIG. 1.
Figure 2C:
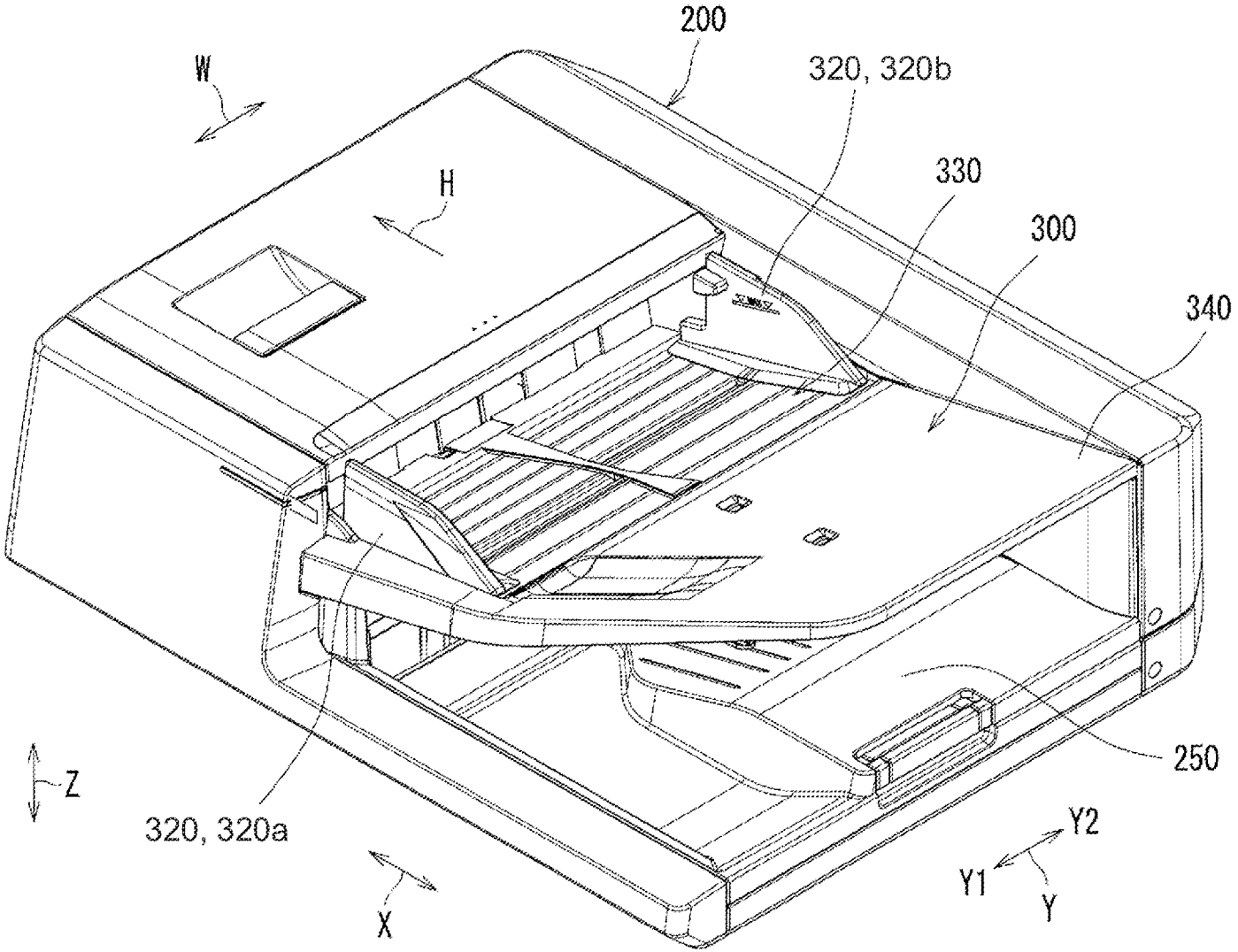
FIG. 2C is a perspective view of the document feed device shown in FIG. 1.
Figure 3A:
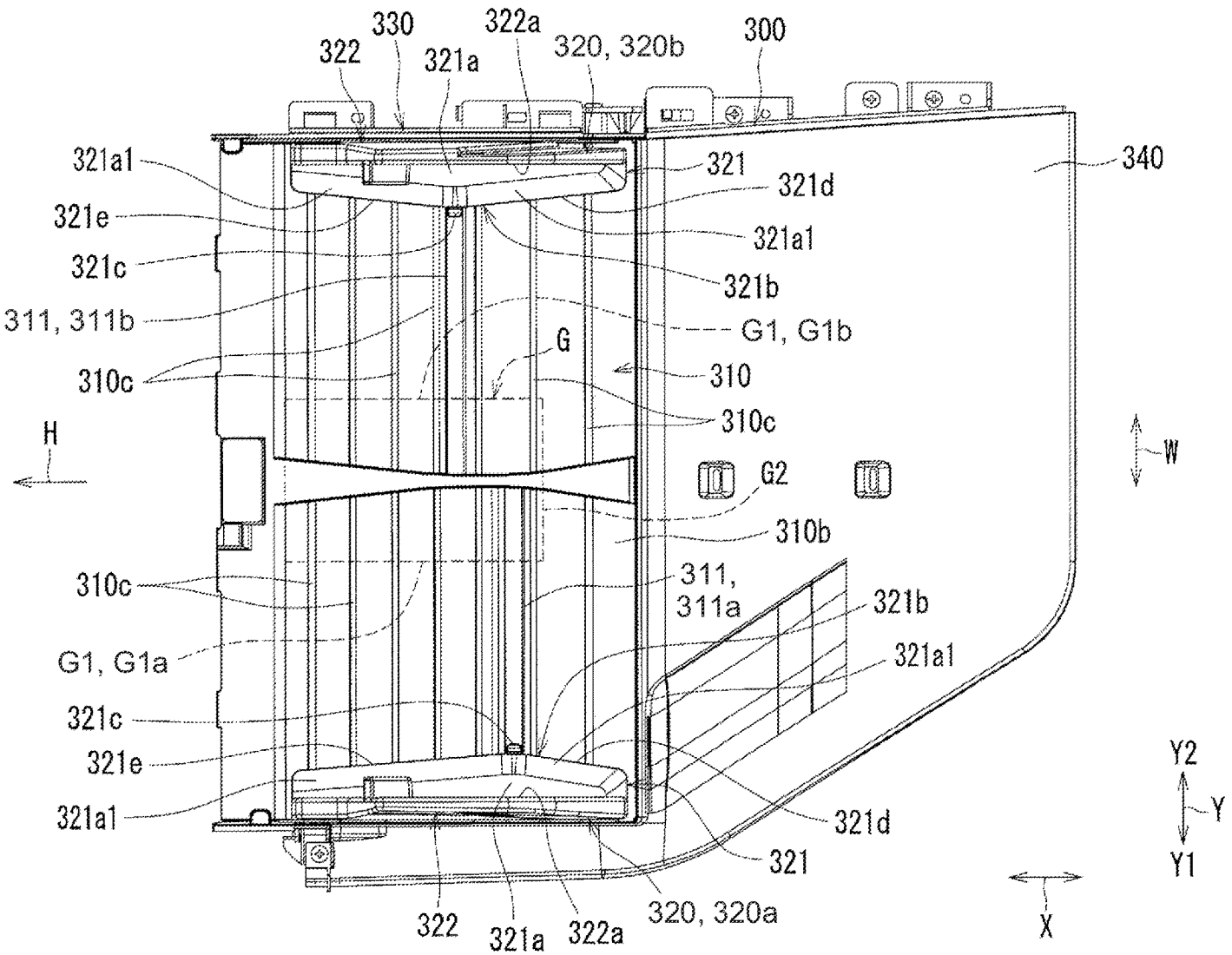
FIG. 3A is a front view of an example of a document tray showing a document guide at its most opened state.
Figure 3B:
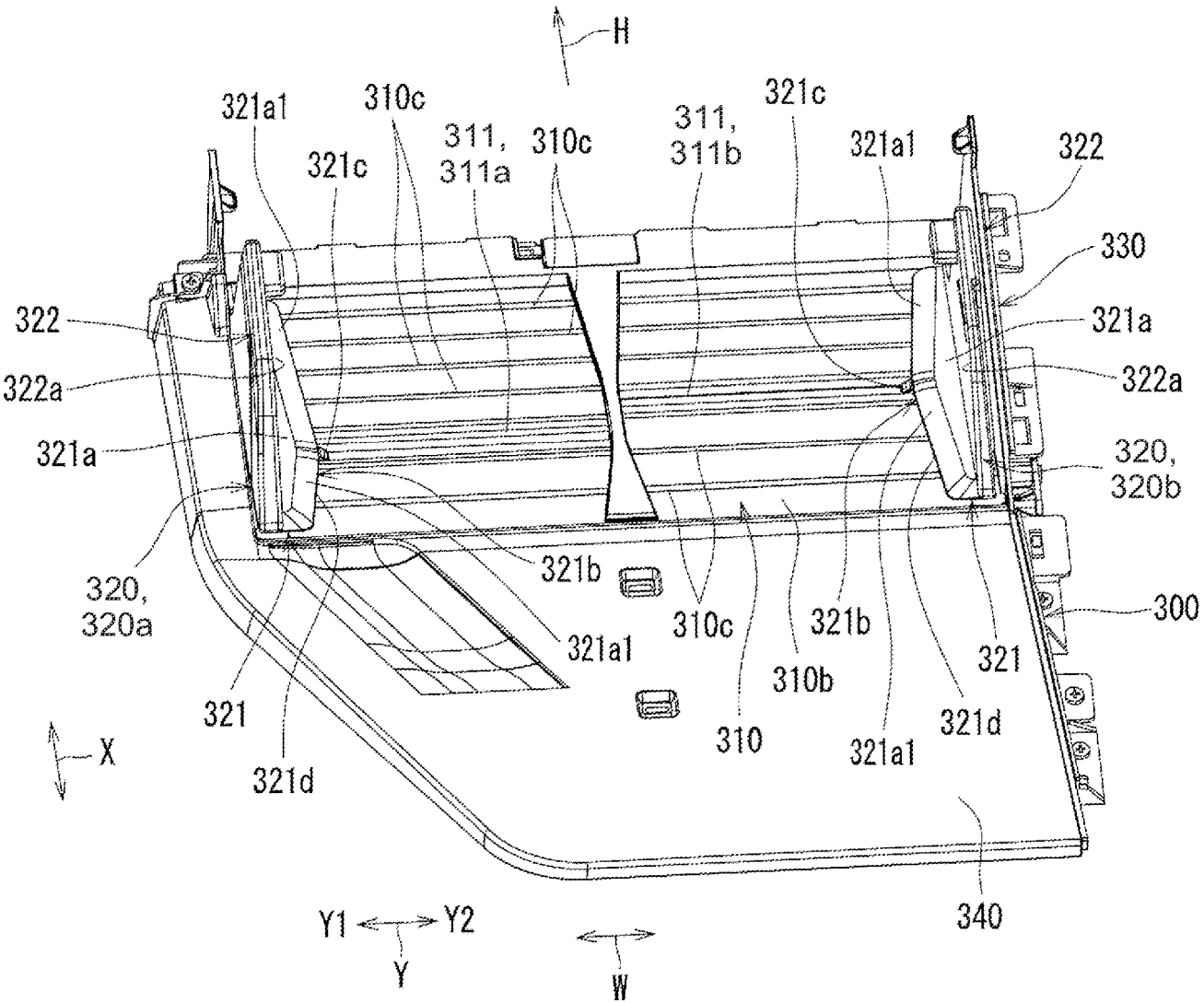
FIG. 3B is a perspective view of an example of the document tray showing the document guide at its most opened state.
Figure 4A:
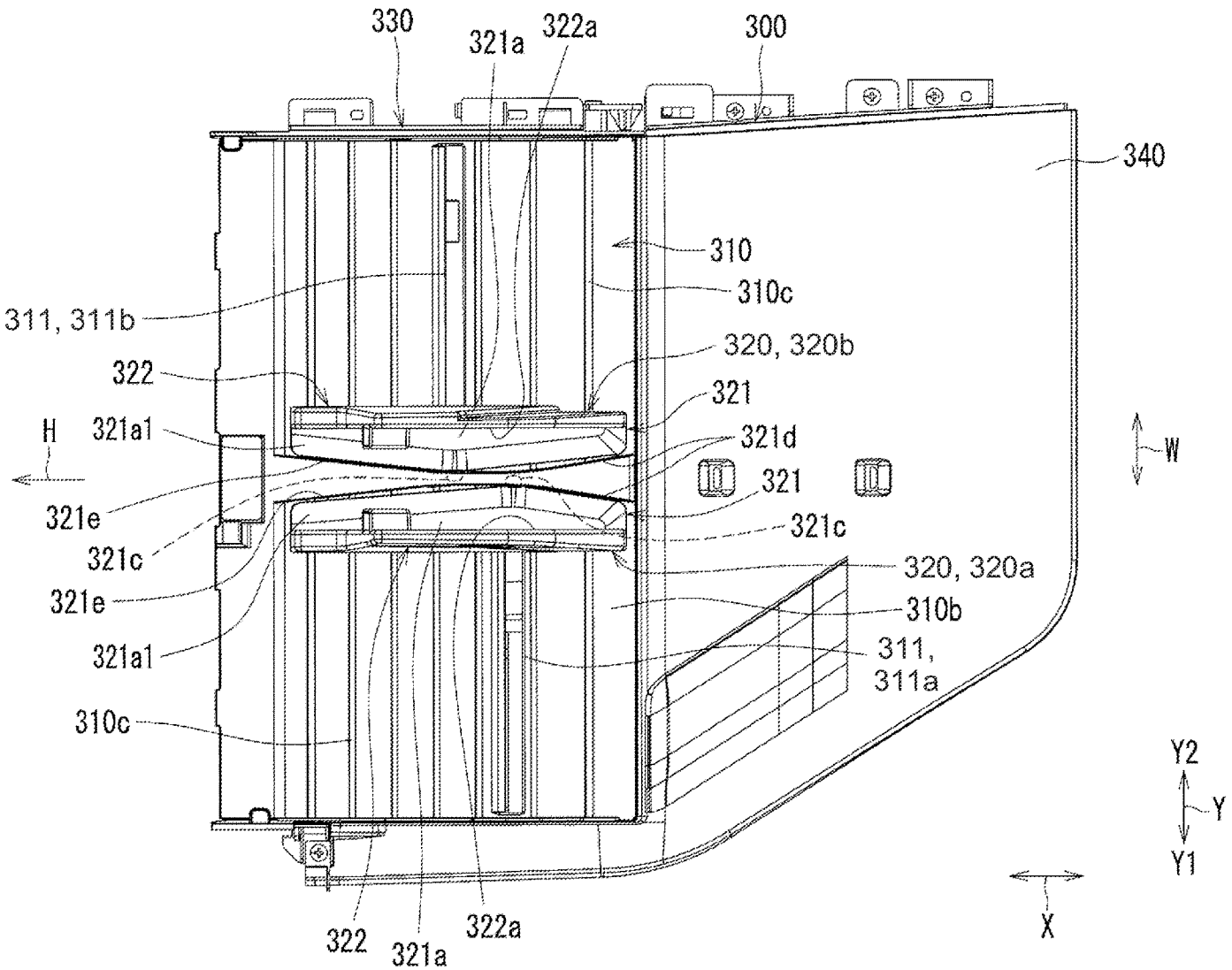
FIG. 4A is a front view of an example of the document tray showing the document guide at its most closed state.
Figure 4B:
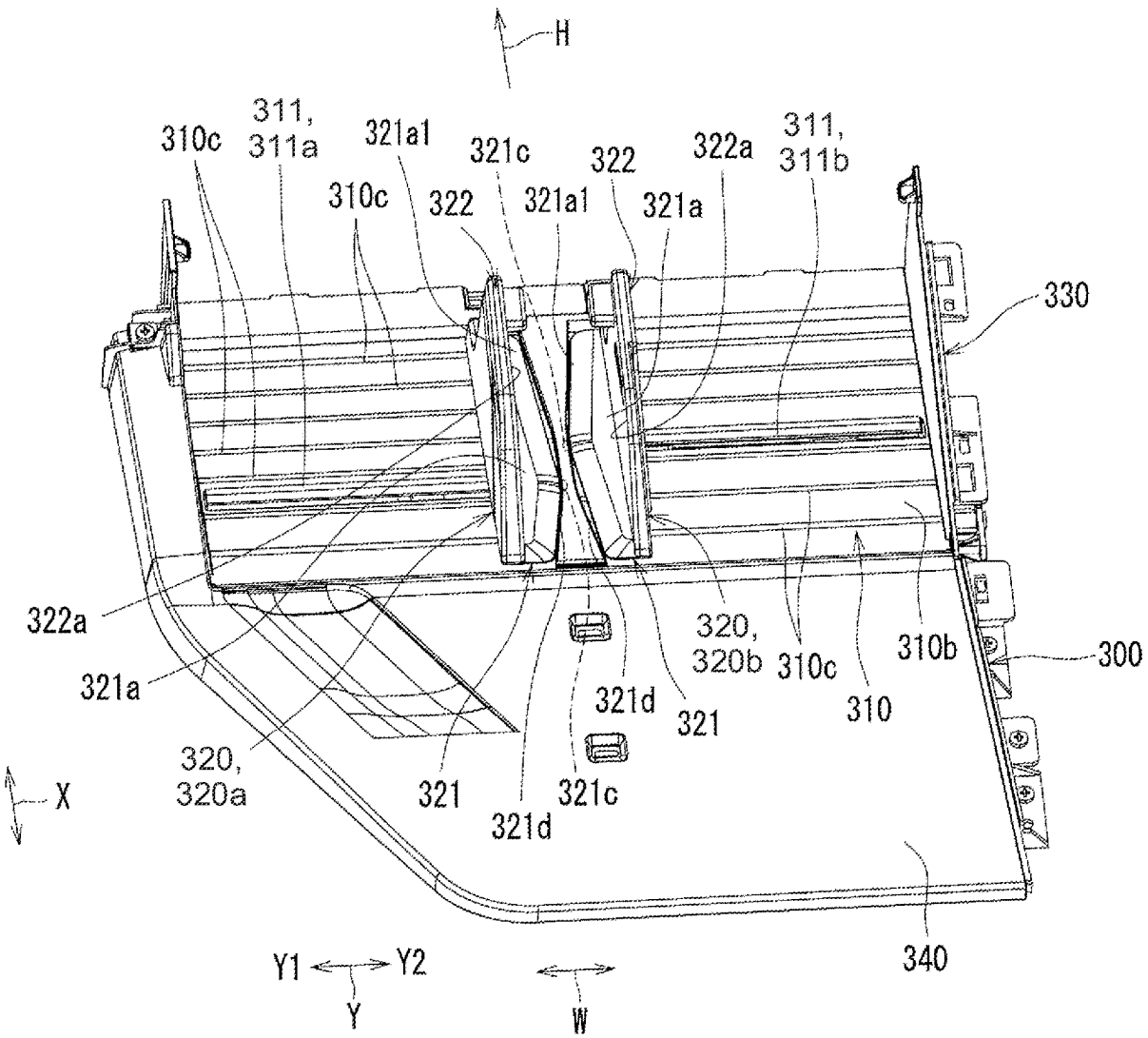
FIG. 4B is a perspective view of an example of the document tray showing the document guide at its most closed state.
Figure 5A:
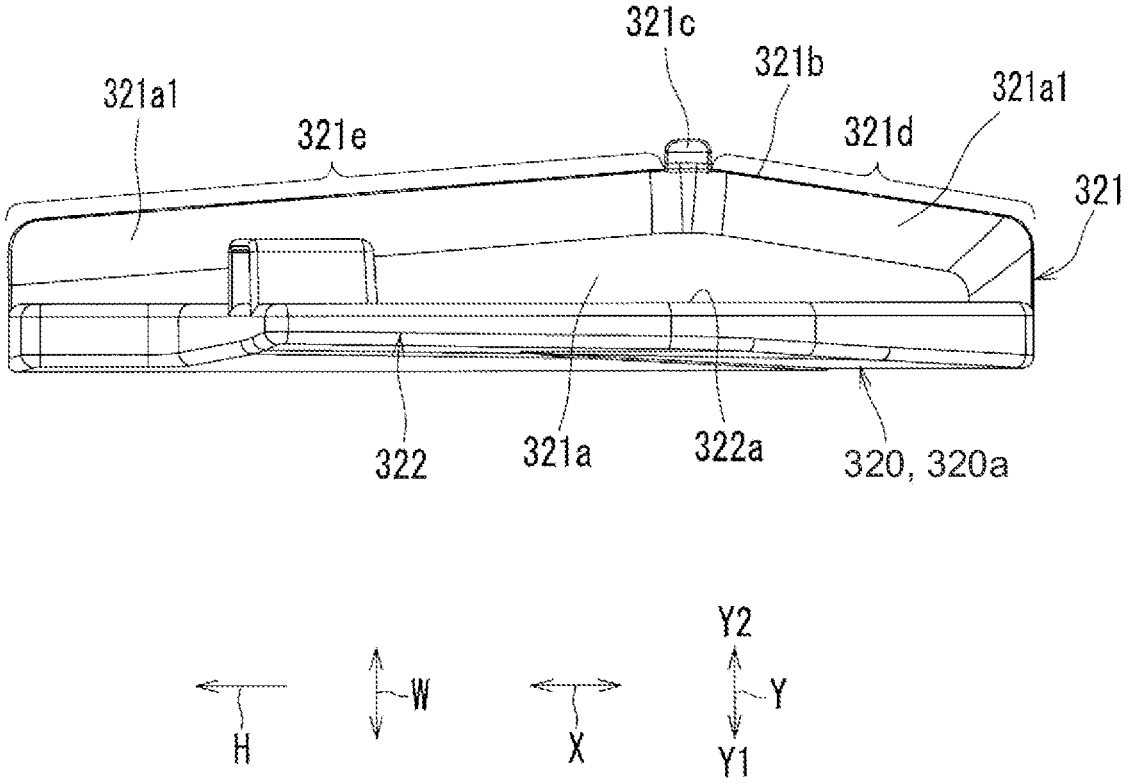
FIG. 5A is a plan view showing the document guide on an operation side.
Figure 5B:
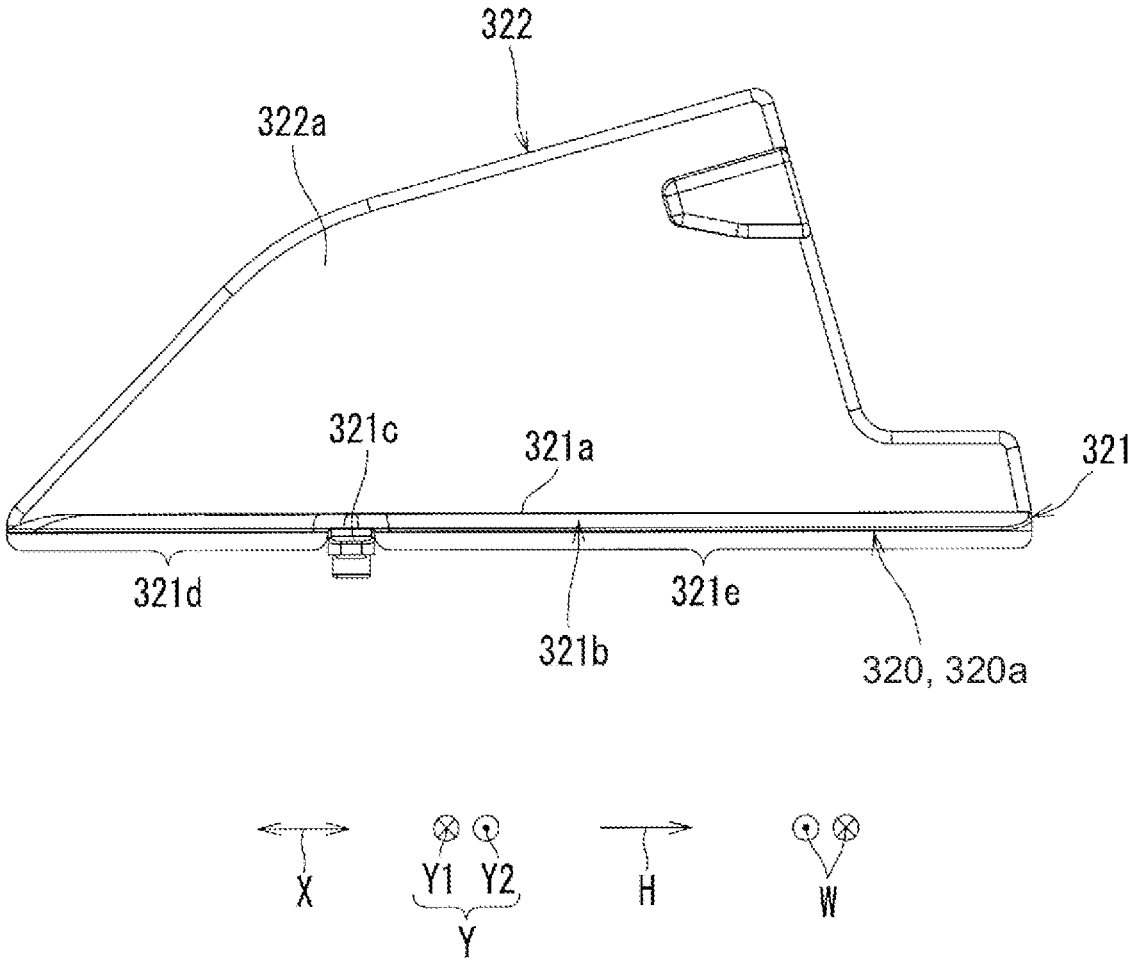
FIG. 5B is a rear view showing the document guide on the operation side.
Figure 5C:
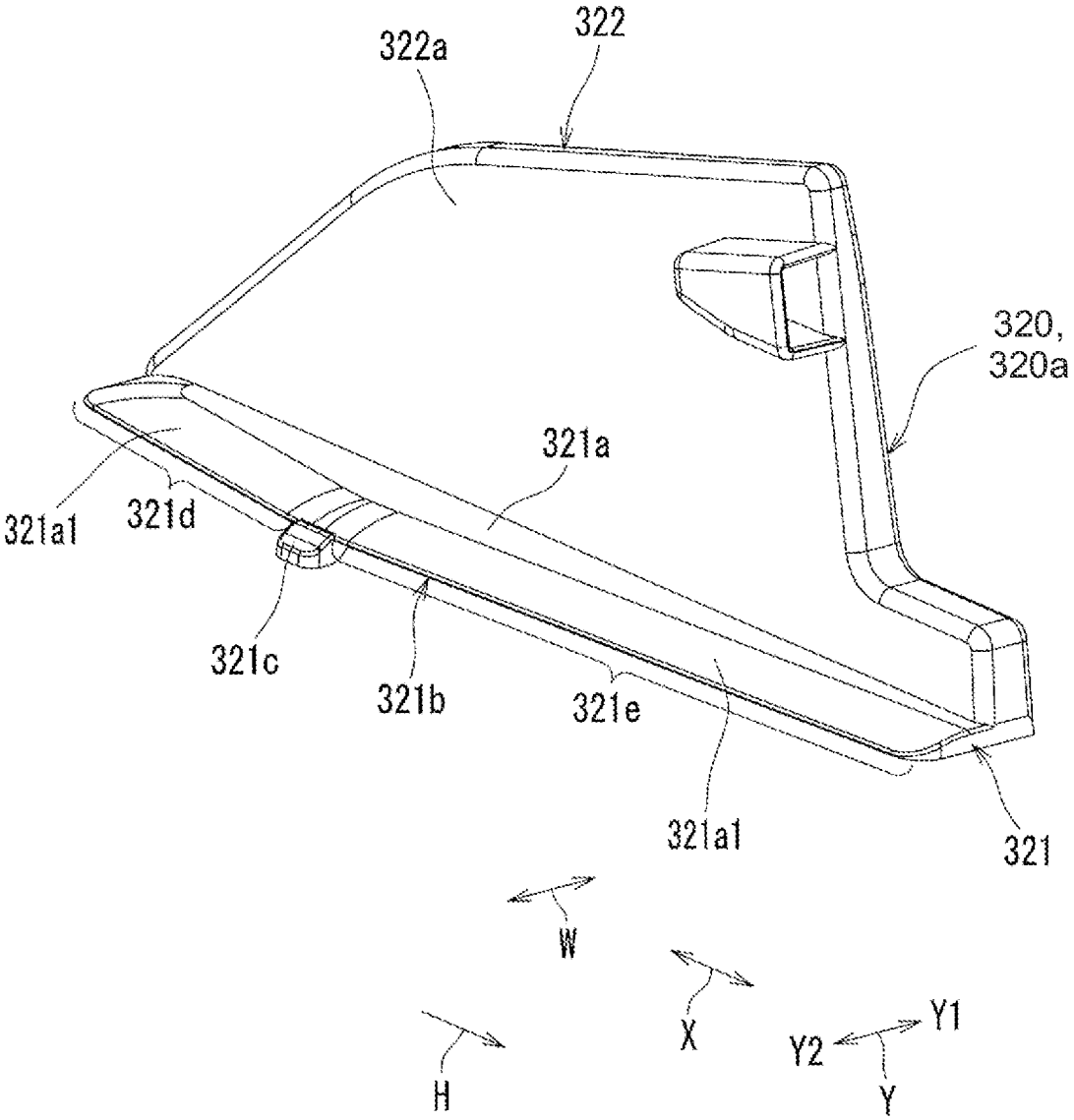
FIG. 5C is a perspective view showing the document guide on the operation side.
Figure 6A:
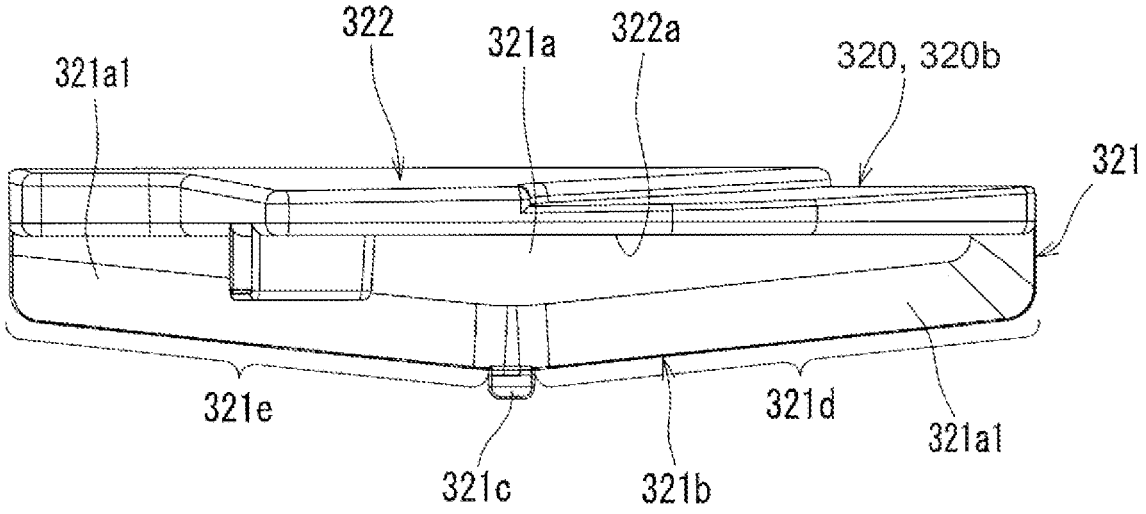
FIG. 6A is a plan view showing the document guide on the opposite side of the operation side.
Figure 6A:
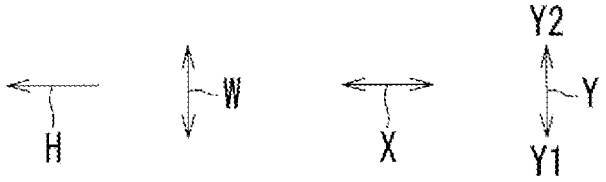
Figure 6B:
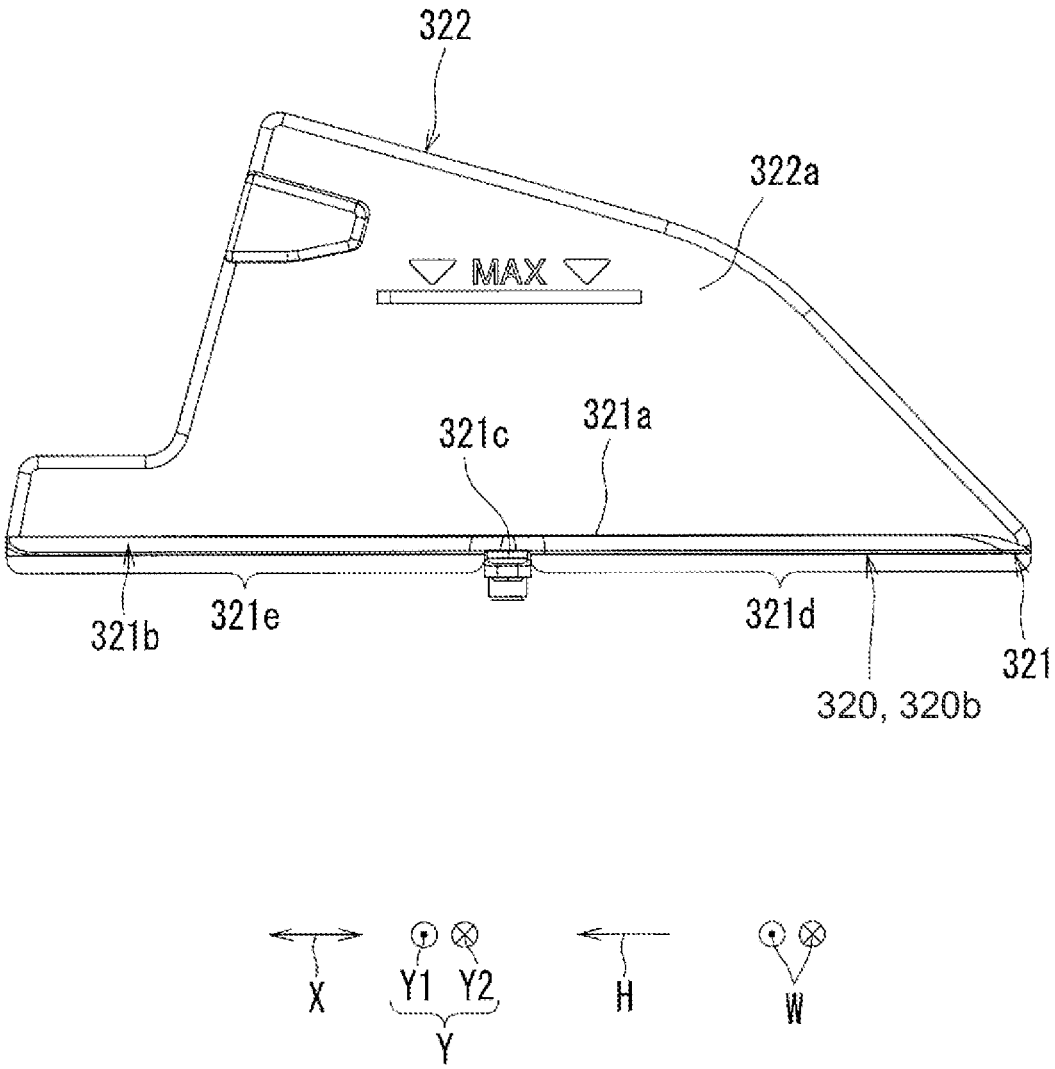
FIG. 6B is a rear view showing the document guide on the opposite side of the operation side.
Figure 6C:
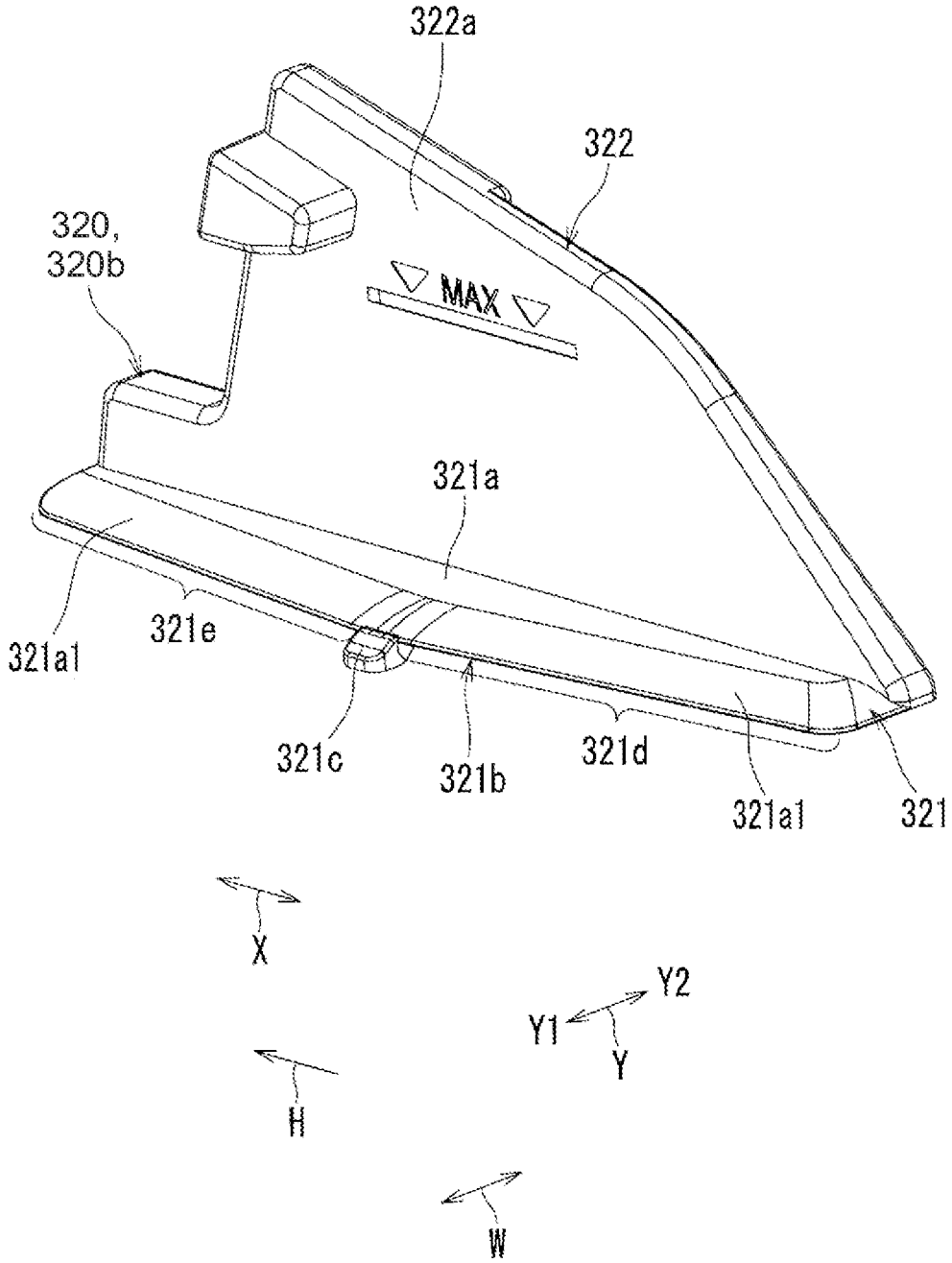
FIG. 6C is a perspective view showing the document guide on the opposite side of the operation side.
Figure 7A:
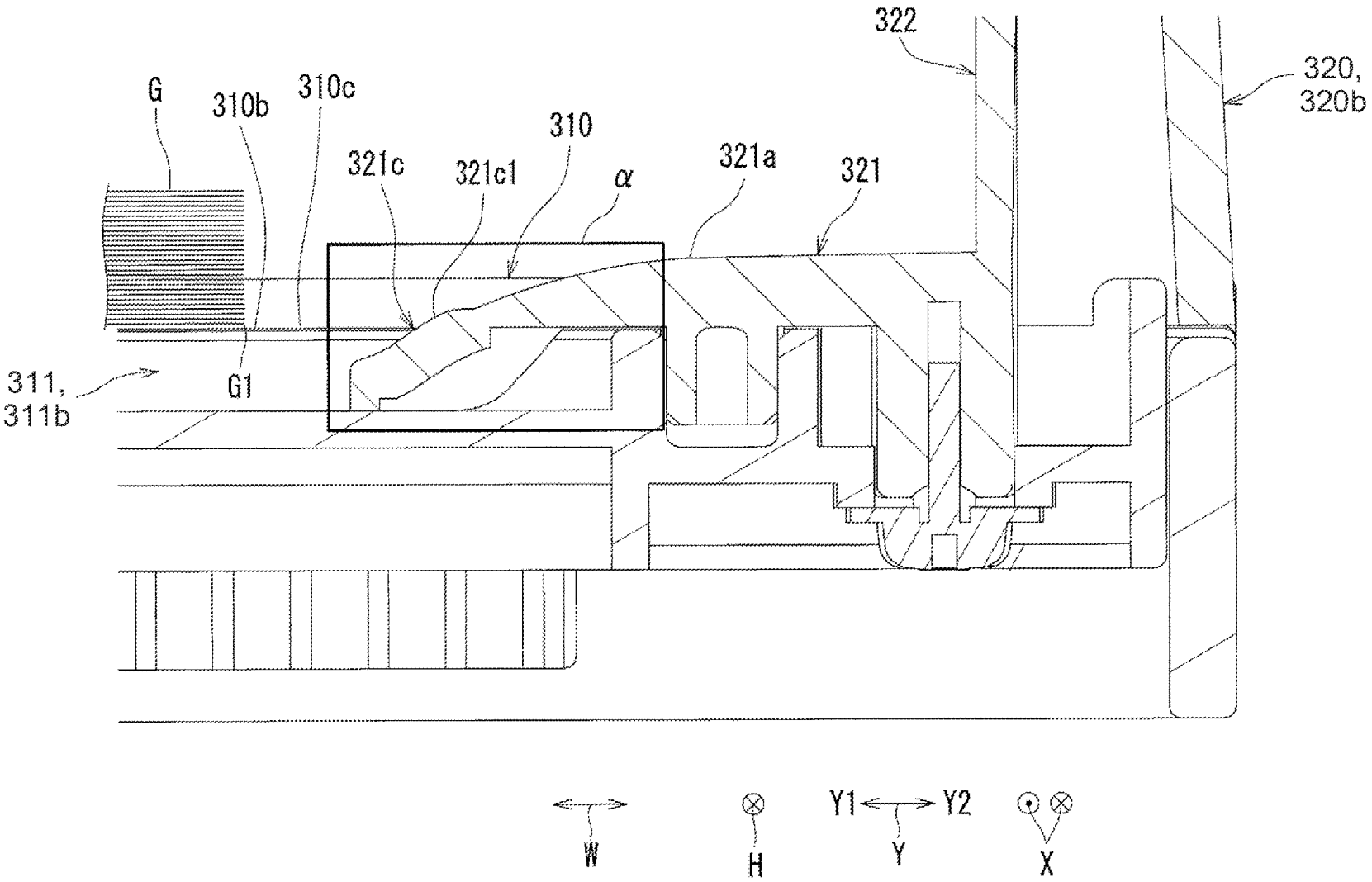
FIG. 7A is a cross-sectional view showing an enlarged portion of a scooper in the document guide on the opposite side of the operation side.
Figure 7B:
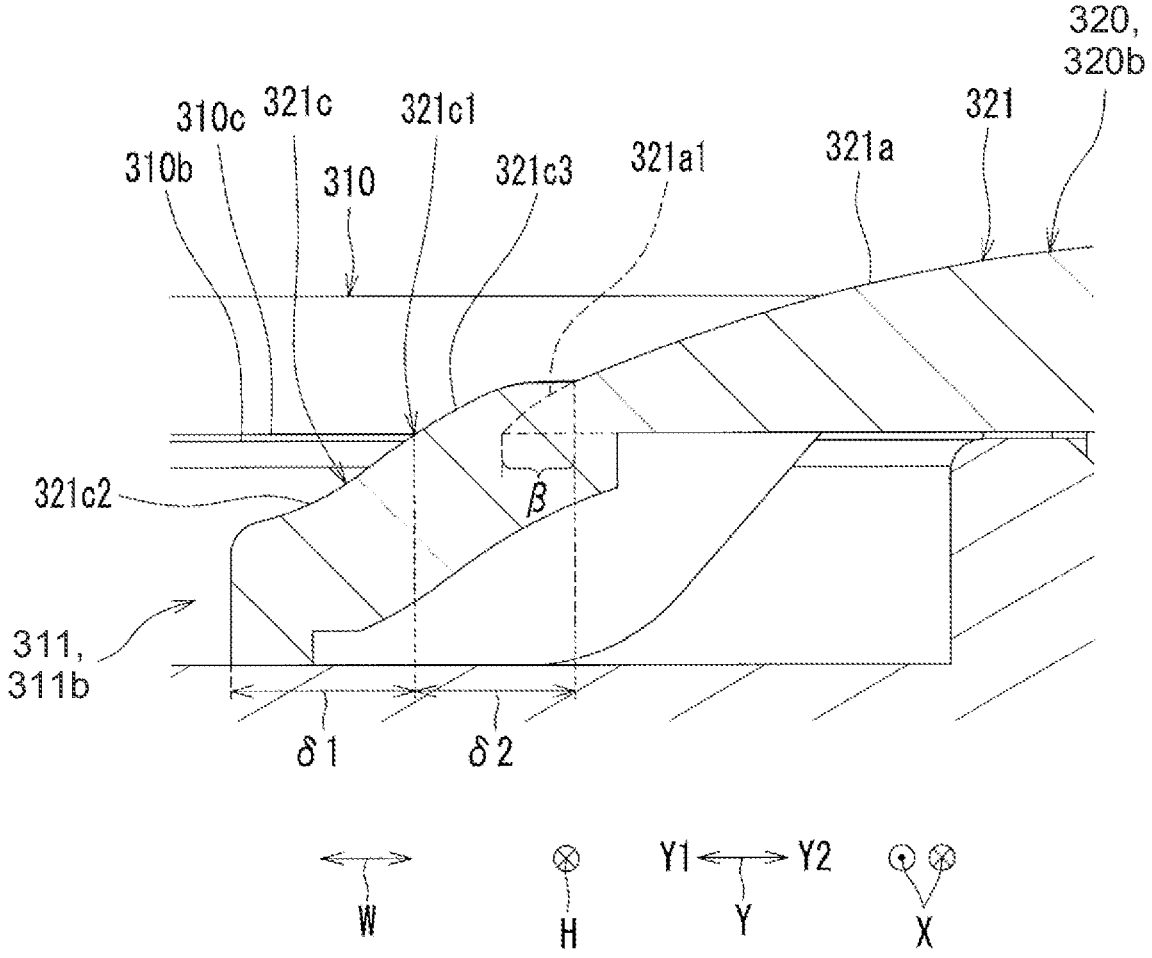
FIG. 7B is a cross-sectional view of an a portion shown in FIG. 7A.

FIG. 2A, FIG. 2B, and FIG. 2C are a plan view, a front view, and a perspective view, respectively, of the document feed device 200 shown in FIG. 1. FIGS. 3A and 3B are a front view and a perspective view of an example of a document tray portion 300, showing document guides 320 at their most opened state. FIGS. 4A and 4B are a front view and a perspective view of an example of the document tray portion 300, showing the document guides 320 at their most closed state. FIGS. 5A to 5C are a plan view, a rear view, and a perspective view, respectively, of a document guide 320*a* on the operation side. FIGS. 6A to 6C are a plan view, a rear view, and a perspective view, respectively, of a document guide 320*b* on the opposite side of the operation side. FIG. 7A is a cross-sectional view showing an enlarged portion of a scooper in the document guide 320*b* on the opposite side of the operation side. FIG. 7B is a cross-sectional view of an a portion shown in FIG. 7A. In FIGS. 7A and 7B, the portion of the scooper in the document guide 320*b* on the opposite side of the operation side is shown, but the same configuration is used for the document guide 320*a* on the operation side, and illustration of the above configuration is omitted here.

The document feed device 200 is provided with the document tray portion 300. The document tray portion 300 has a downstream document tray portion 330 and an upstream document tray portion 340. The downstream document tray portion 330 is provided at the downstream side in a conveying direction H of the document G. The upstream document tray portion 340 is connected to the upstream side of the downstream document tray portion 330 in the conveying direction H of the document G. The downstream document tray portion 330 and the upstream document tray portion 340 are formed of a resin material.

The downstream document tray portion 330 is provided with the document tray 310 for loading the document G and also provided with the document guide 320 (320*a*, 320*b*). In the examples shown in FIGS. 2A and 3A, the document G is a business card. The business card is the smallest size document that can be conveyed by the document feed device 200. The document guide 320 guides (regulates) at least one end side G1 (in this example, both end sides G1*a*, G1*b*) in a width direction W orthogonal to the conveying direction H of the document G loaded on the document tray 310.

The document guide 320 has a document guide side document loader 321 and a document guide member 322. The document guide side document loader 321 has a document loading face 321*a* on which the document G is loaded. Here, the document guide side document loader 321 is a plate-shaped member having, on its upper face, the document loading face 321*a*. Examples of portions, of the document guide side document loader 321, other than the document loading face 321*a* include a side face along the up-down direction Z, and a convex curved face formed between the document loading face 321*a* and the upper end of the side face along the up-down direction Z. The document guide member 322 has a document guide face 322*a* that is erected from the document guide side document loader 321 and guides the end side G1 of the document G. Here, the document guide member 322 is a plate-shaped member having, on its inner face, the document guide face 322*a*. The document guide side document loader 321 and the document guide member 322 are integrally formed.

The document tray 310 is provided with grooves 311 (311*a*, 311*b*) extending along the width direction W for reciprocating movement of the document guide 320 in the width direction W. In this example, the groove 311 is a through groove.

The document guide 320 has a scooper 321*c* and an upstream outline portion 321*d*. Here, an upstream outline portion 321*d* is a concept that includes a ridge of the document guide side document loader 321. Therefore, the document loading face 321*a* of the document guide side document loader 321 does not include the ridge of the document guide side document loader 321. To an end 321*b* in the width direction W of the document guide side document loader 321, the scooper 321*c* scoops up the end side G1 of the document G when the document guide 320 is moved toward the document G loaded on the document tray 310. In detail, the scooper 321*c* protrudes from the document guide side document loader 321 to the document G's loading side in the width direction W, and has a tip end positioned below the document loading face 321*a* of the document guide 320. In this example, the scooper 321*c* and the document guide side document loader 321 are integrally formed.

The upstream outline portion 321*d* is formed so as to gradually approach the document guide member 322 toward the upstream side in the conveying direction H with the scooper 321*c* as an apex.

In the present embodiment, in the case where the document guide side document loader 321 is opened outside the size of the document G and the document G is loaded inside the document guide side document loader 321, when the document guide 320 is moved to the document G side, the end side G1 of the document G can be scooped up by the scooper 321*c* prior to the document guide side document loader 321. Here, the upstream outline portion 321*d* provided at the end 321*b* of the document guide side document loader 321 is formed so as to gradually approach the document guide member 322 toward the upstream side in the conveying direction H with the scooper 321*c* as the apex. From this, when the document guide 320 is moved to the document G side, the end side G1 of the document G can easily intersect with the upstream outline portion 321*d*. This can suppress the end side G1 of the document G from entering the lower side of the upstream outline portion 321*d* in the document guide side document loader 321, and thereby can effectively prevent the document G from being damaged and injured.

The upstream outline portion 321*d* may be formed, for example, into a linear inclined shape portion, a convex curved shape portion, a concave curved shape portion, a convex elliptical arc shape portion, or a concave elliptical arc shape portion.

In this example, the upstream outline portion 321*d* of the document guide side document loader 321 is a linearly inclined shape portion that gradually slopes to approach the document guide member 322 toward the upstream side in the conveying direction H with the scooper 321*c* as the apex.

With this, when the document guide 320 is moved to the document G side, the end side G1 of the document G is more easily intersected with the upstream outline portion 321*d*. This can further suppress the end side G1 of the document G from entering the lower side of the upstream outline portion 321*d* in the document guide side document loader 321, and thereby can effectively prevent the document G from being damaged and injured.

In this embodiment, as shown in FIGS. 7A and 7B, the scooper 321*c* protrudes from the upper portion of the document loading face 321*a* of the document guide side document loader 321 to the document G's loading side in the width direction W. The scooper 321*c* (protruding portion) is inclined so as to become higher toward the document guide member 322 side in the width direction W. An inclined face 321*c*1 of the scooper 321*c* is positioned on the upper side of the document loading face 321*a* of a portion 6 that corresponds to the scooper 321*c* of the document guide side document loader 321, as shown in FIG. 7B.

With this, the document G scooped up by the scooper 321*c* can be positioned at a position higher than the document loading face 321*a* of the document guide 320. This can further suppress the end side G1 of the document G from entering the lower side of the upstream outline portion 321*d* in the document guide side document loader 321, and thereby can effectively prevent the document G from being damaged and injured.

In this example, the document loading face 321*a* of the document guide 320 has an inclined face 321*a*1 that slopes so as to become higher toward the document guide member 322 side in the width direction W.

In the present embodiment, the scooper 321*c* is provided at a corresponding location, which corresponds to the groove 311, of the end 321*b* on the document G's loading side in the width direction W of the document guide side document loader 321.

With this, an upper face 321*c*2 of a tip end side 61 of the scooper 321*c* (see FIG. 7B) can be positioned lower than an upper face 310*b* of the document tray 310 (convex portion 310*c* in this example), and an upper face 321*c*3 of a base end side 62 of the scooper 321*c* (see FIG. 7B) can be positioned higher than the upper face 310*b* (convex portion 310*c* in this example) of the document tray 310.

In the present embodiment, a downstream outline portion 321*e* is provided at the end 321*b*, on the document G's loading side in the width direction W, of the document guide side document loader 321. Here, the downstream outline portion 321*e* is a concept that includes the ridge of the document guide side document loader 321. The downstream outline portion 321*e* is formed so as to gradually approach the document guide member 322 toward the downstream side in the conveying direction H with the scooper 321*c* as the apex.

By doing so, in the case where the document guide side document loader 321 is opened outside the size of the document G and the document G is loaded inside the document guide side document loader 321, when the document guide 320 is moved to the document side, the end side G1 of the document G can easily intersect with the downstream outline portion 321*e*. This can suppress the end side G1 of the document G from entering the lower side of the downstream outline portion 321*e* in the document guide side document loader 321, and thereby can effectively prevent the document G from being damaged and injured.

The downstream outline portion 321*e* may be formed, for example, into a linear inclined shape portion, a convex curved shape portion, a concave curved shape portion, a convex elliptical arc shape portion, or a concave elliptical arc shape portion.

In this example, the downstream outline portion 321*e* is a linearly inclined shape portion that is inclined so as to gradually approach the document guide member 322 toward the downstream side in the conveying direction H with the scooper 321*c* as the apex.

With this, when the document guide 320 is moved to the document G side, the end side G1 of the document G more easily intersects with the downstream outline portion 321*e*. This can further suppress the end side G1 of the document G from entering the lower side of the downstream outline portion 321*e* in the document guide side document loader 321, and thereby can effectively prevent the document G from being damaged and injured.

In the present embodiment, the scooper 321*c* is positioned downstream from the position of the rear end of the document G (an end side G2 on the upstream side in the conveying direction H), which position is seen when the document G that is the smallest in size (e.g., a business card) and that is conveyable in the conveying direction H is loaded on the document tray 310.

With this, even if the smallest size document G that can be conveyed is loaded on the document tray 310, in the case where the document G is loaded on the document tray 310 with the document guide side document loader 321 opened outside the size of the document G, when the document guide 320 is moved to the document G side, the end side G1 of the document G can be scooped up by the scooper 321*c* prior to the document guide side document loader 321.

In the present embodiment, the document guides 320 are a pair of document guides 320*a* and 320*b* that guide the end sides G1 (Gla, Glb) on both sides in the width direction W of the document G loaded on the document tray 310, respectively.

The grooves 311 provided at the document tray 310 are a pair of grooves 311*a* and 311*b* extending along the width direction W for reciprocating movement of the pair of document guides 320*a* and 320*b*, respectively, in the width direction W. The pair of document guides 320*a* and 320*b* have the document guide side document loader 321 and the document guide member 322, respectively. The scoopers 321*c* are provided at the document guide side document loaders 321 of the pair of document guides 320*a* and 320*b* (in this example, corresponding locations that correspond to the grooves 311*a* and 311*b* of the document guide side document loaders 321), respectively. At the ends 321*b* and 321*b* on the document G's loading side in the width direction W of the document guide side document loaders 321 of the pair of document guides 320*a* and 320*b*, the upstream outline portions 321*d* and 321*d* are provided, respectively.

This can correspond to the configuration in which the document G is conveyed based on the center in the width direction W.

In this embodiment, the scooper 321*c* in any one of the pairs of document guides 320*a* and 320*b* (320*b* in this example) is positioned at the central portion in the conveying direction H of the document guide side document loader 321.

With this, when the pair of document guides 320*a* and 320*b* are both moved inward in the width direction W, the document G scooped up by the scooper 321*c* at any one of the document guides (320*b* in this example) can be evenly loaded on the document loading face 321*a* of the document guide side document loader 321, on both sides with the scooper 321*c* in between in the conveying direction H.

In this embodiment, the scooper 321*c* in the document guide on the operation side (320*a* in this example) operated by the operator, among the pair of document guides 320*a* and 320*b*, is positioned on the upstream side, in the conveying direction H, of the scooper 321*c* in the document guide on the opposite side of the operation side (320*b* in this example).

With this, even if the scooper 321*c* in the document guide (320*a*) on the operation side is positioned on the upstream side, in the conveying direction H, of the scooper 321*c* in the document guide (320*b*) on the opposite side of the operation side, when the pair of document guides 320*a* and 320*b* are both moved inward in the width direction W, the document G can be securely scooped up by the scooper 321*c* in each of the pair of document guides 320*a* and 320*b*.

Figure 8:
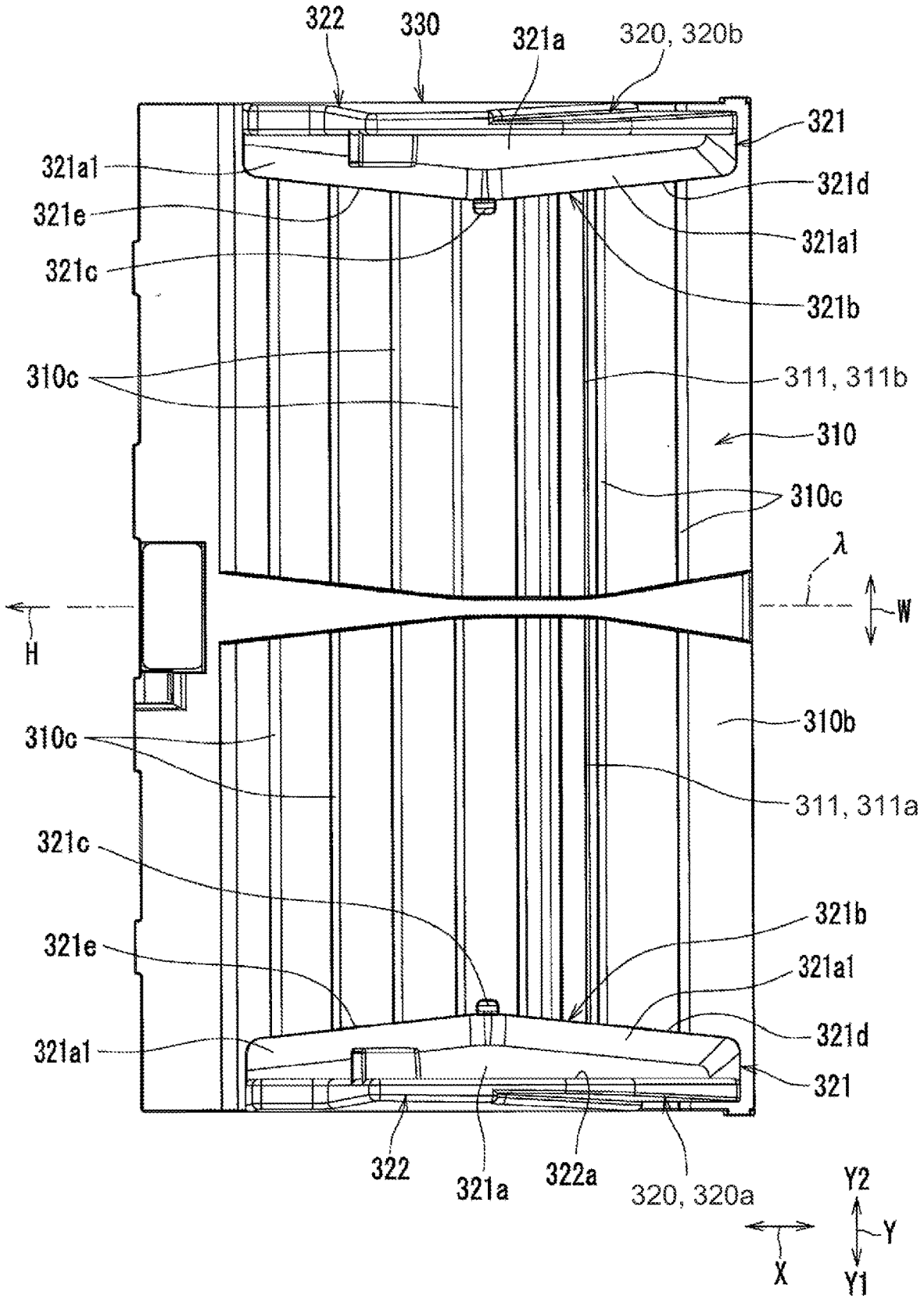
FIG. 8 is a plan view showing an example in which, in a downstream document tray portion, a pair of grooves are aligned at the same position in the conveying direction at the document tray.

FIG. 8 is a plan view showing an example in which, in the downstream document tray portion 330, a pair of grooves 311*a*, 311*b* are aligned at the same position in the conveying direction H at the document tray 310.

By the way, as shown in FIG. 8, the pair of grooves 311*a*, 311*b* can be aligned at the same position in the conveying direction H at the document tray 310. In this case, however, the inward movable range of the pair of document guides 320*a*, 320*b* in the width direction W is easily limited, and it is difficult to accommodate the small size document G such as a business card. The downstream document tray portion 330 shown in FIG. 8 has an axisymmetric or substantially axisymmetric shape with respect to an axis line A along the conveying direction H in the center in the width direction W. In the example shown in FIG. 8, the scooper 321*c* is not provided in the groove 311 (311*a*, 311*b*), but is positioned on the upper face 310*b* of the document tray 310.

In this regard, in the present embodiment, the pair of grooves 311*a*, 311*b* are staggered at a predetermined distance in the conveying direction H at the document tray 310.

By doing so, the inward movable range of the pair of document guides 320*a*, 320*b* in the width direction W can be increased, thereby making it easier to accommodate the small size document G such as a business card.

Figure 9:
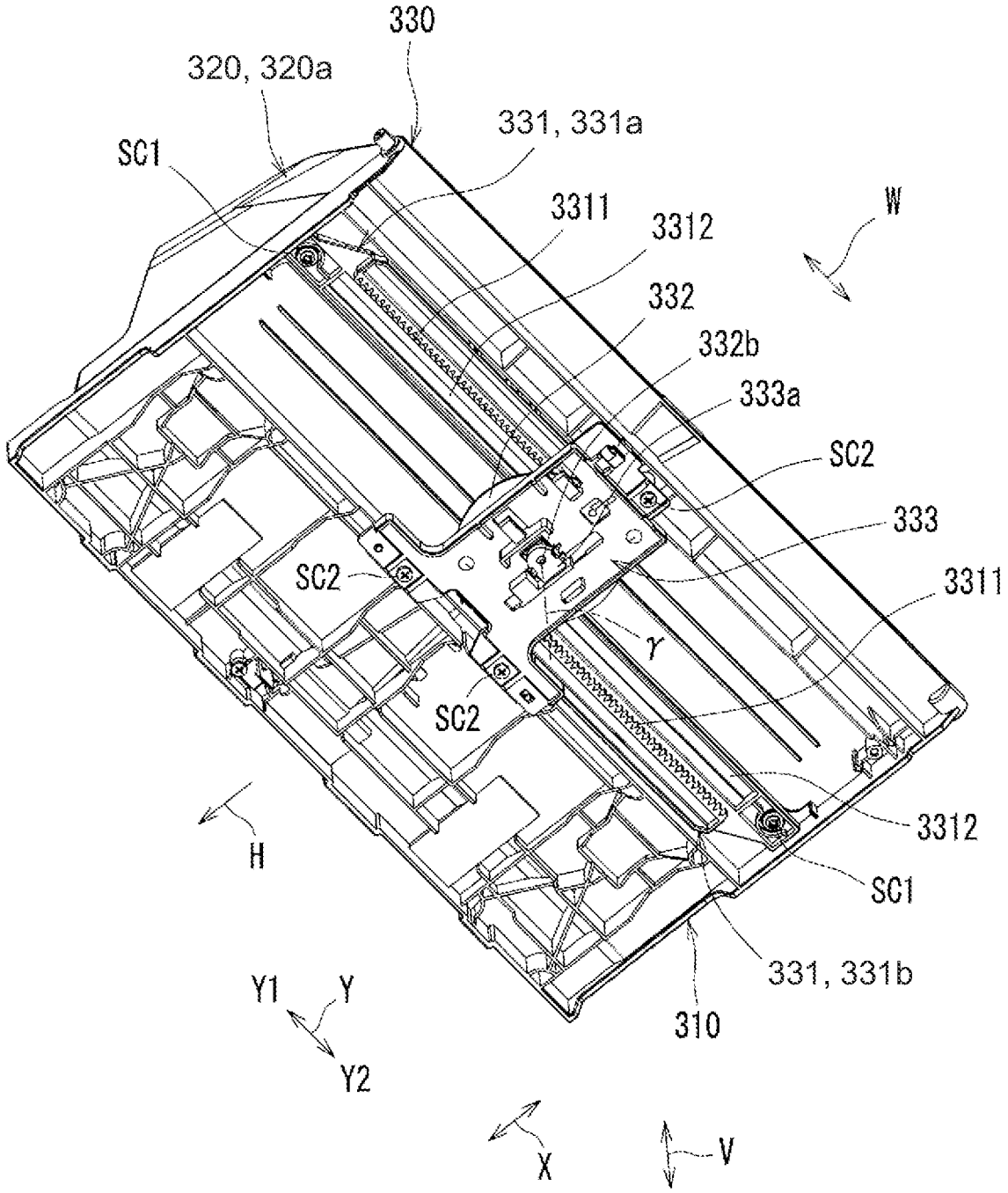
FIG. 9 is a perspective view of the downstream document tray portion shown in FIGS. 3A to 4B, viewed from below.
Figure 10A:
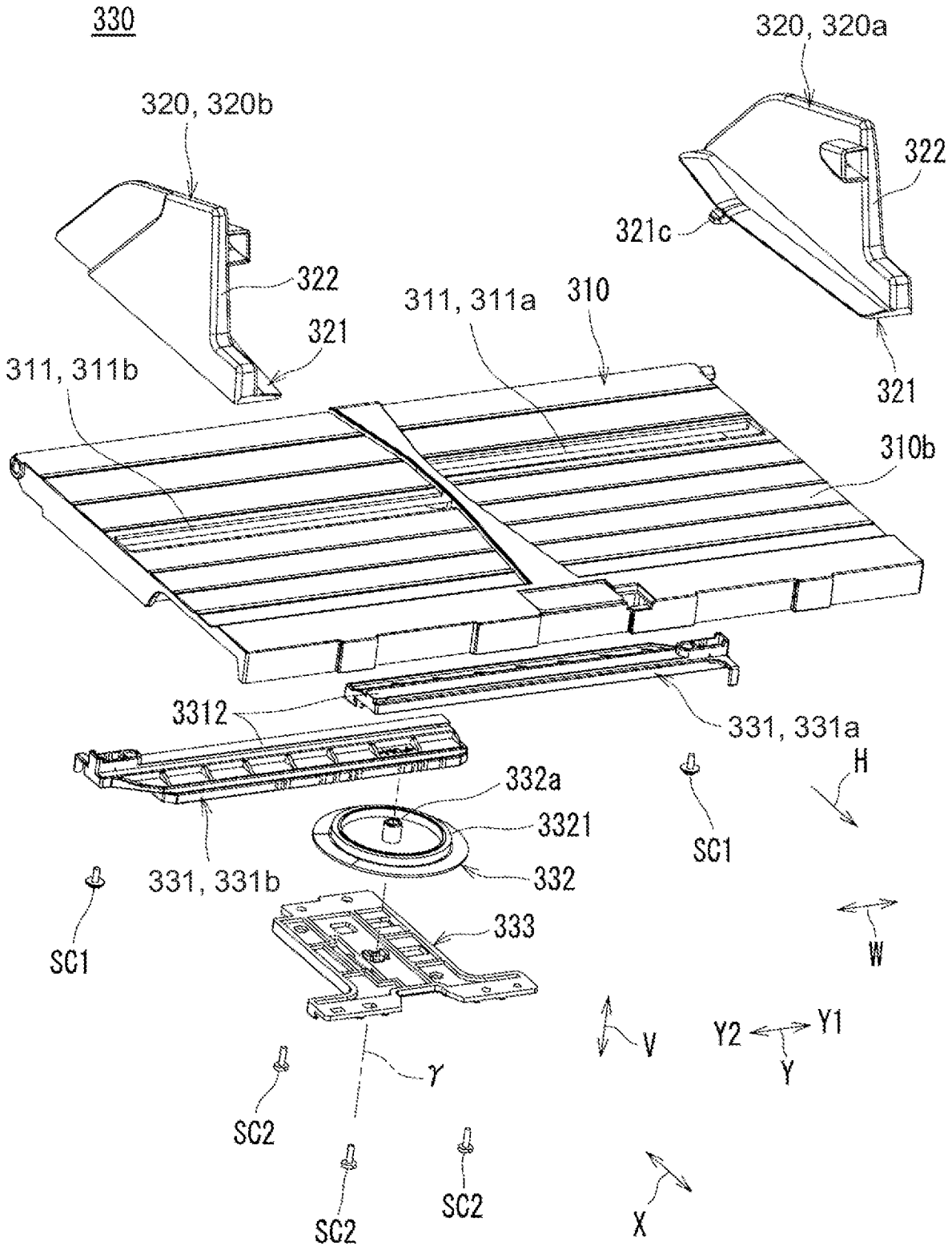
FIG. 10A is an exploded perspective view of the downstream document tray portion shown in FIG. 9, viewed from above.
Figure 10B:
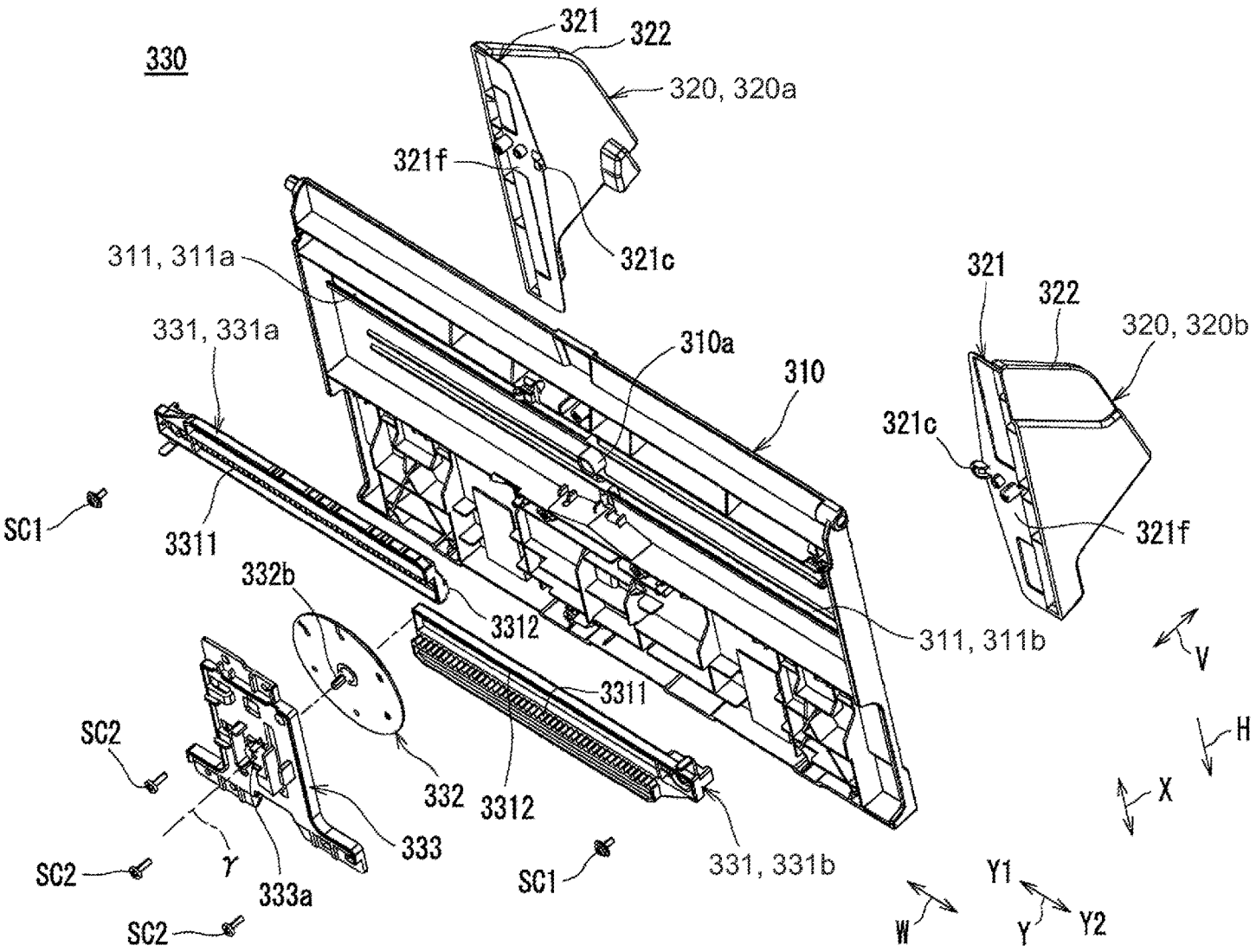
FIG. 10B is an exploded perspective view of the downstream document tray portion shown in FIG. 9, viewed from below.

FIG. 9 is a perspective view of the downstream document tray portion 330 shown in FIGS. 3A to 4B, viewed from below. FIGS. 10A and 10B are exploded perspective views of the downstream document tray portion 330 shown in FIG. 9, viewed from above and from below, respectively.

As shown in FIGS. 9, 10A and 10B, a pinion portion 332 having a pinion gear 3321 for reciprocally moving the pair of document guides 320*a*, 320*b* in the width direction W is provided between the pair of grooves 311*a*, 311*b*.

With this, the pair of document guides 320*a*, 320*b* can be easily reciprocally moved in the width direction W, with a simple configuration such as using a pinion gear 3321.

In detail, the downstream document tray portion 330 is further provided with a rack 331, the pinion portion 332, and a holding member 333.

The rack 331 has a rack gear 3311 extending along the width direction W. The rack 331 includes a pair of racks 331*a* and 331*b* corresponding to the pair of document guides 320*a* and 320*b*, respectively.

By fixing members SC1, SC1 such as screws, the pair of racks 331*a*, 331*b* are fixed to the pair of document guides 320*a*, 320*b* via the pair of grooves 311*a*, 311*b* provided at the document tray 310, respectively. The pair of racks 331*a* and 331*b* are, respectively, provided with rack gears 3311 and 3311 and groove blocking portions 3312 and 3312 extending along the width direction W. In an opposing manner, the rack gears 3311 and 3311 mesh with the pinion gear 3321 each other, with the pinion gear 3321 therebetween. The groove blocking portions 3312, 3312 are connected to the pinion gear 3321 in the conveying direction H. The groove blocking portions 3312, 3312 close the pair of grooves 311*a*, 311*b* as the pair of document guides 320*a*, 320*b* move outward in the width direction W. The rack gears 3311, 3311 and the groove blocking portions 3312, 3312 are integrally formed.

The pinion portion 332 has a rotational shaft 332*a* (see FIG. 10A) which protrudes to one side in a rotational axis line direction V as the direction of a rotational axis line y and which is rotatably supported by a bearing portion 310*a* (see FIG. 10B) provided at the document tray 310. Further, the pinion portion 332 has a rotational shaft 332*b* (see FIG. 10B) which protrudes to another side in the rotational axis line direction V and which is rotatably supported by a bearing portion 333*a* (see FIGS. 9, 10B) provided at the holding member 333.

The pinion portion 332 is held by the holding member 333 to the document tray 310 in a manner to rotate around the rotational axis line y. The holding member 333 is fixed to the document tray 310 by fixing members SC2-SC2 such as screws, with the rotational shaft 332*a* on one side of the pinion portion 332 being inserted into the bearing portion 310*a* at the document tray 310, and the rotational shaft 332*b* on the other side of the pinion portion 332 being inserted into the bearing portion 333*a* at the holding member 333.

Figure 11A:
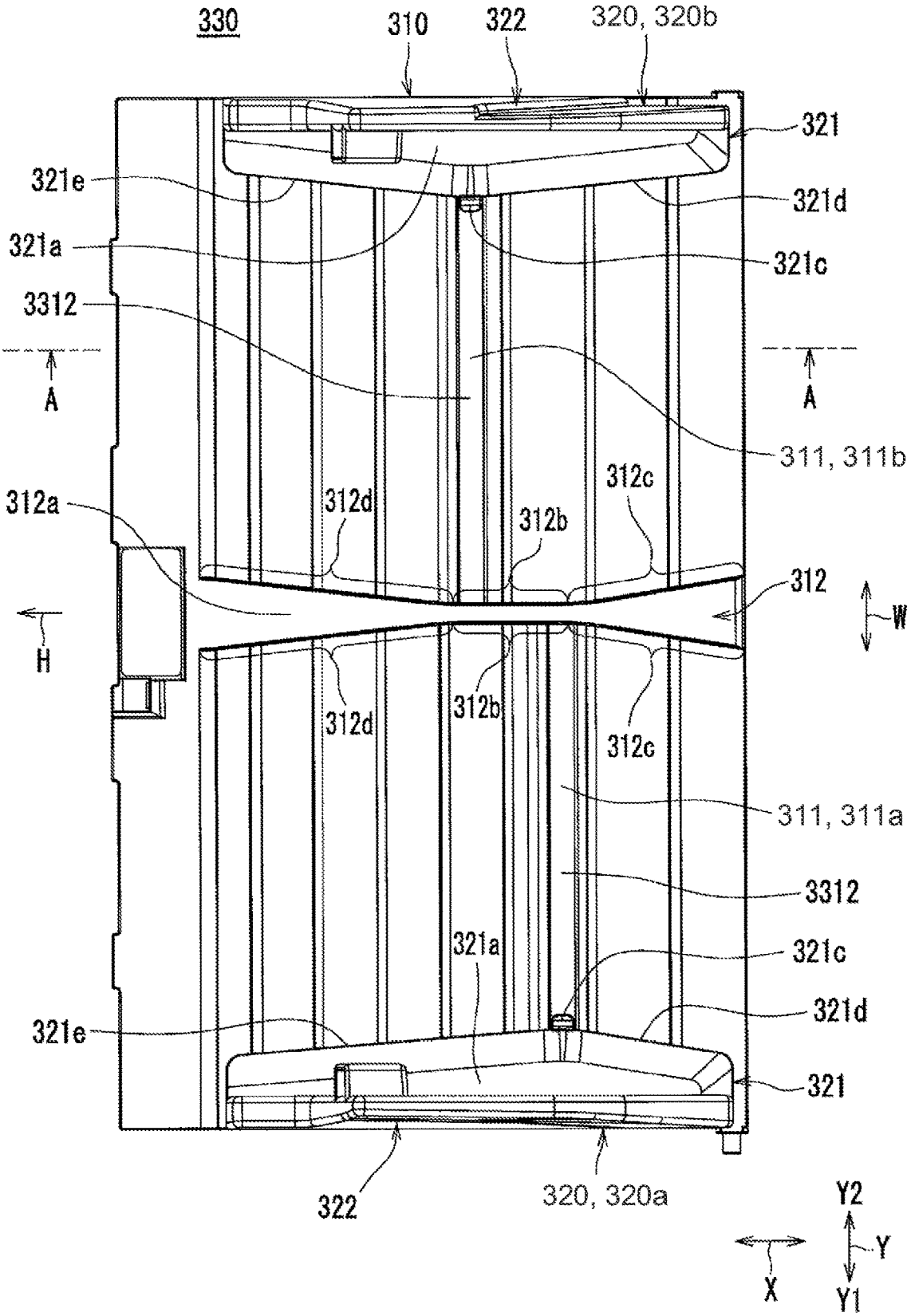
FIG. 11A is a front view of the downstream document tray portion showing the document guides in their most opened states.
Figure 11B:
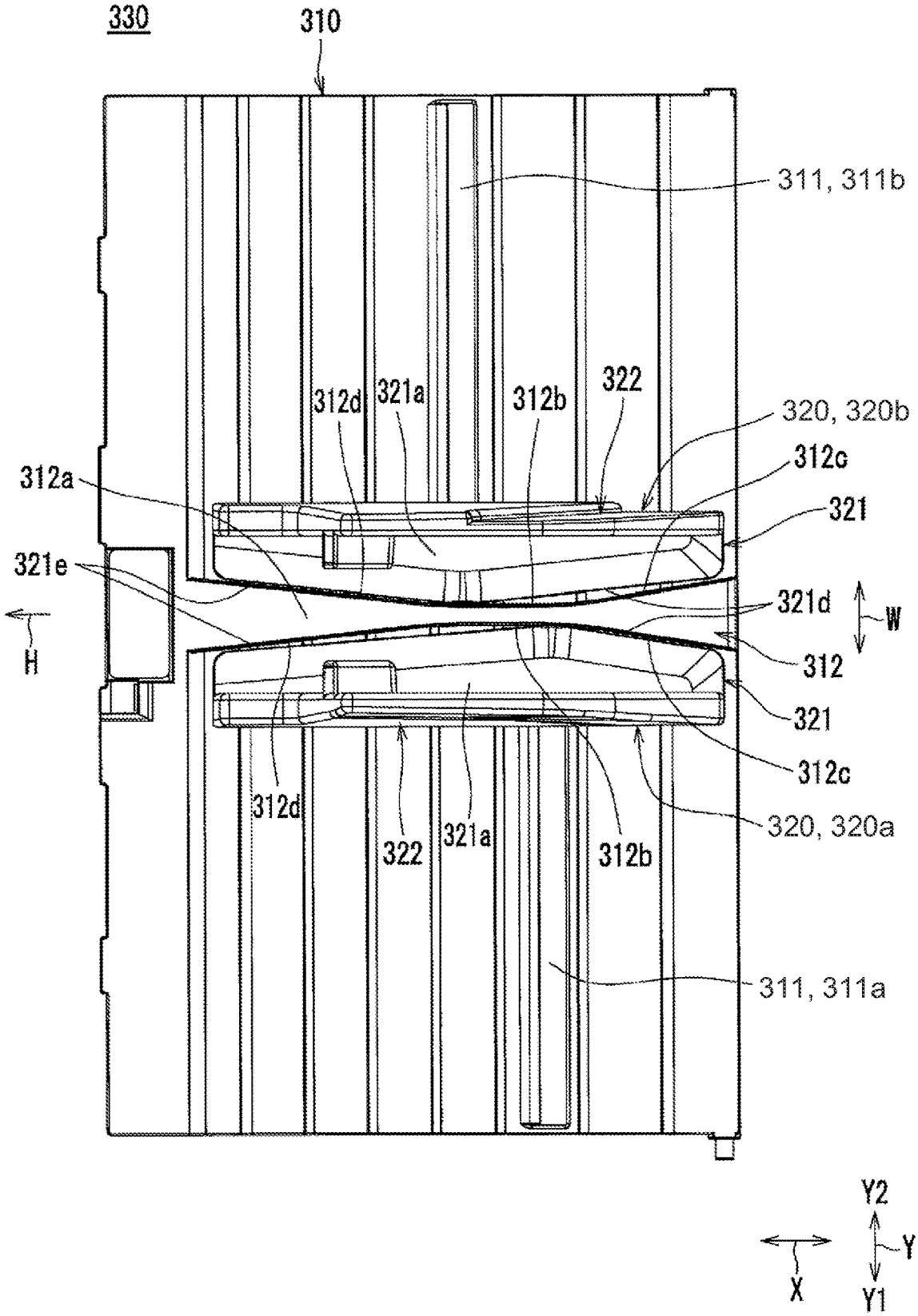
FIG. 11B is a front view of the downstream document tray portion showing the document guide in their most closed states.

FIG. 11A is a front view of the downstream document tray portion 330 showing the document guides 320 (320*a*, 320*b*) in their most opened states. FIG. 11B is a front view of the downstream document tray portion 330 showing the document guides 320 (320*a*, 320*b*) in their most closed states.

As shown in FIGS. 11A and 11B, a flat portion 312 is provided at a central portion in the width direction W of the document tray 310. The flat portion 312 has a document loading face 312*a* along the document loading face 321*a* of the document guide side document loader 321. The document loading face 312*a* of the flat portion 312 loads the document G at the central portion in the width direction W of the document tray 310. Here, examples of portions, of the flat portion 312, other than the document loading face 312*a* include the side face along the up-down direction Z, and a convex curved face formed between the document loading face 312*a* and the upper end of the side face along the up-down direction Z. The document loading face 321*a* of the document guide 320 and the document loading face 312*a* of the document tray 310 are flush. That is, the document loading face 321*a* of the document guide 320 and the document loading face 312*a* of the document tray 310 are aligned in the height direction (rotational axis line direction V).

With this, the document G can be securely loaded on the document loading face 321*a* of the document guide 320 at the document guide side document loader 321 of the document guide 320 (320*a*, 320*b*), and the document G can be securely loaded also on the document loading face 312*a* of the document tray 310 at the flat portion 312 of the document tray 310.

In this embodiment, the flat portion 312 has a linear outline portion 312*b* and an upstream outline portion 312*c*. The linear outline portion 312*b* is formed in a linear line along the conveying direction H in a manner to include the portion that corresponds to the scooper 321*c*. The upstream outline portion 312*c* is formed in a manner to be connected from the linear outline portion 312*b* to the upstream side.

With this, the upstream outline 312*c* can be formed along or substantially along the upstream outline 321*d* of the document guide side document loader 321 in the document guide 320 (320*a*, 320*b*). Therefore, when the document guide 320 (320*a*, 320*b*) is most closed, a gap between the top portion in the width direction W of the document guide side document loader 321 of the document guide 320 (320*a*, 320*b*) and the linear outline 312*b* in the flat portion 312, and a gap between the upstream outline 321*d* in the document guide side document loader 321 and the upstream outline 312*c* in the flat portion 312 can be reduced or eliminated. This allows the document G to be stably loaded on the document guide side document loader 321 and the flat portion 312.

In addition, a downstream outline portion 312*d* is further provided in the flat portion 312. The downstream outline portion 312*d* is connected to the downstream side from the linear outline portion 312*b* and is formed so as to gradually move away from the central portion in the width direction W toward the downstream side in the conveying direction H.

With this, the downstream outline portion 312*d* can be formed along or substantially along the downstream outline portion 321*e* of the document guide side document loader 321 in the document guide 320 (320*a*, 320*b*). Accordingly, when the document guide 320 (320*a*, 320*b*) is most closed, the gap between the downstream outline portion 321*e* in the document guide side document loader 321 and the downstream outline portion 312*d* in the flat portion 312 can be reduced or eliminated. This allows the document G to be stably loaded on the document guide side document loader 321 and the flat portion 312.

For example, it may be so made that, in the case of guiding (regulating) the smallest size document G when the document guide 320 (320*a*, 320*b*) is most closed, the document guide member 322 in the document guide 320 (320*a*, 320*b*) guides (regulates) the end side G1 (Gla, Glb) in the width direction W.

Figure 12A:
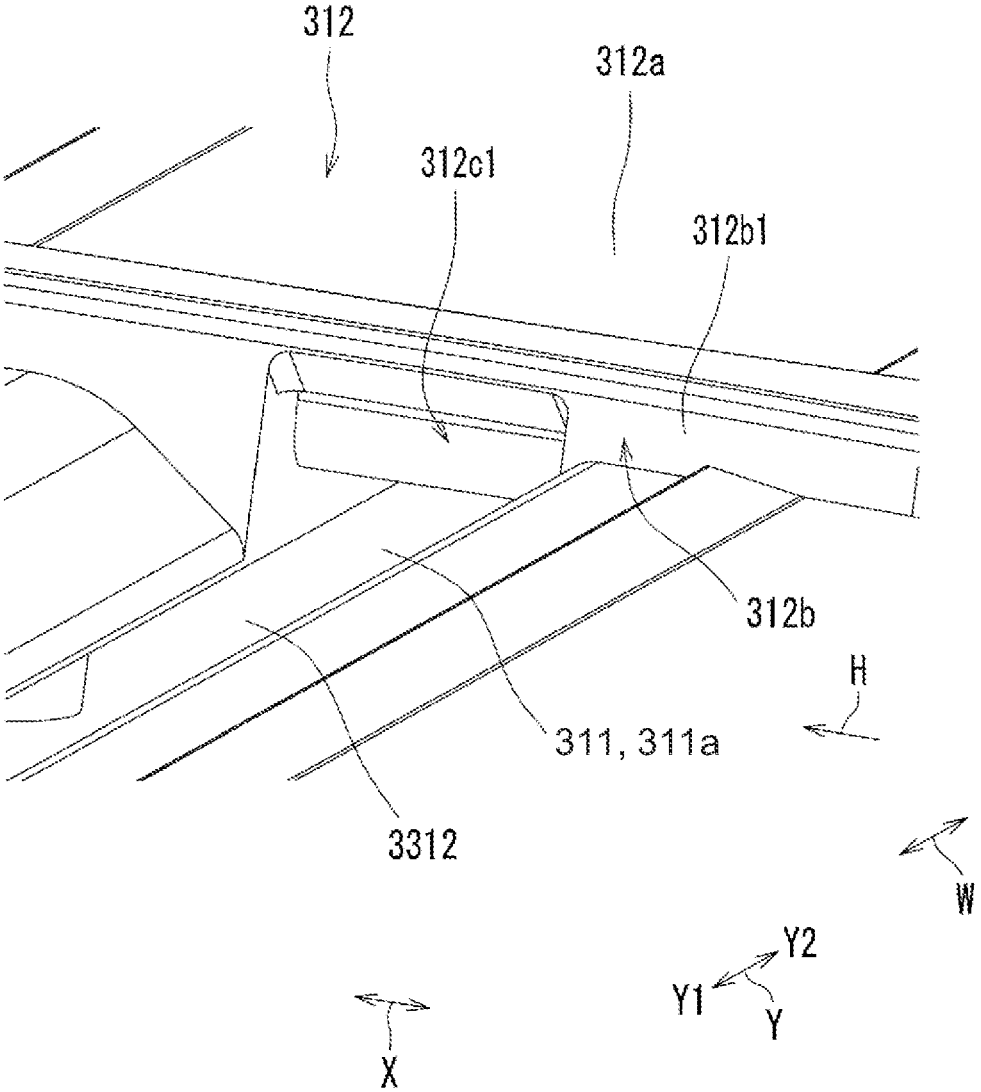
FIG. 12A is an enlarged view showing a depressed portion provided in a linear outline portion on the operation side.
Figure 12B:
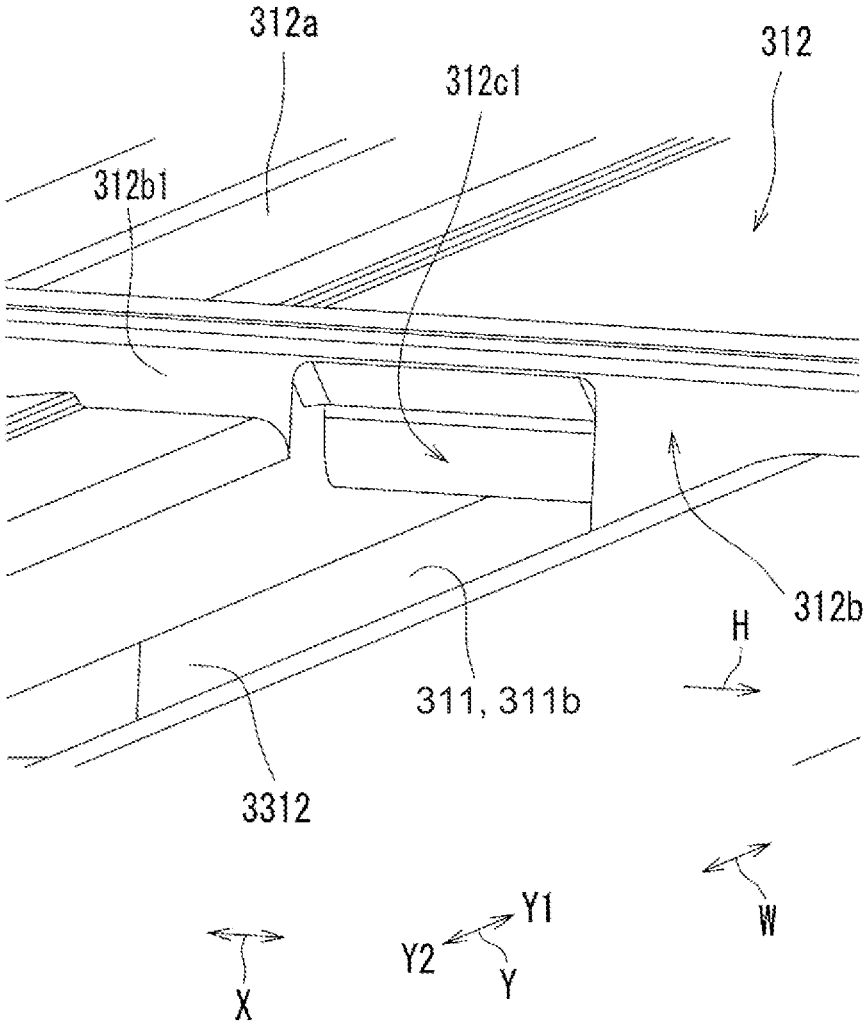
FIG. 12B is an enlarged view showing a depressed portion provided in the linear outline portion on the opposite side of the operation side.

FIGS. 12A and 12B are enlarged views showing a depression 312C1 portion provided in the linear outline portion 312*b* on the operation side and the opposite side of the operation side, respectively.

In this embodiment, the scooper 321*c* dives into the flat portion 312 (see FIGS. 11A, 11B, 12A, and 12B). In this example, a side face 312*b*1 of the linear outline portion 312*b* has the depression 312*c*1 in a shape corresponding to the scooper 321*c*. The depression 312*c*1 has a space sufficient to allow the scooper 321*c* to dive into.

With this, when the document guide 320 (320*a*, 320*b*) is most closed, the gap between the top portion in the width direction W at the document guide side document loader 321 of the document guide 320 (320*a*, 320*b*) and the flat portion 312 can be eliminated.

By the way, when the grooves 311 (311*a*, 311*b*) are through grooves, as in the present embodiment, a foreign object such as a paper clip, at the document tray 310, may fall through the grooves 311 (311*a*, 311*b*) to the lower part (in this example, the document discharge tray 250).

In this regard, in the present embodiment, the document guide 320 (320*a*, 320*b*) has the rack 331 (331*a*, 331*b*). The document guide 320 (320*a*, 320*b*) blocks the groove 311 (311*a*, 311*b*) by a part of the rack 331 (331*a*, 331*b*) (in this example, the groove blocking portion 3312, 3312).

With this, this configuration though being simple can, at the inner side of the document guide member 322 in the width direction W in the document tray 310, prevent the foreign object such as paper clip from falling through the grooves 311 (311*a*, 311*b*) to the lower part (the document discharge tray 250 in this example).

By the way, the document guides 320 (320*a*, 320*b*) move reciprocally in the width direction W relative to the document tray 310, therefore, when the upper face 310*b* of the document tray 310 (see FIG. 10A) and a lower face 321*f* (see FIG. 10B) of the document guide side document loader 321 in the document guides 320 (320*a*, 320*b*) slide against each other, the contact area between the upper face 310*b* of the document tray 310 and the lower face 321*f* of the document guide side document loader 321 in the document guides 320 (320*a*, 320*b*) becomes large, thereby making it difficult to smoothly reciprocally move the document guides 320 (320*a*, 320*b*) in the width direction W relative to the document tray 310. In this regard, the following configuration is used for this embodiment.

Figure 13A:
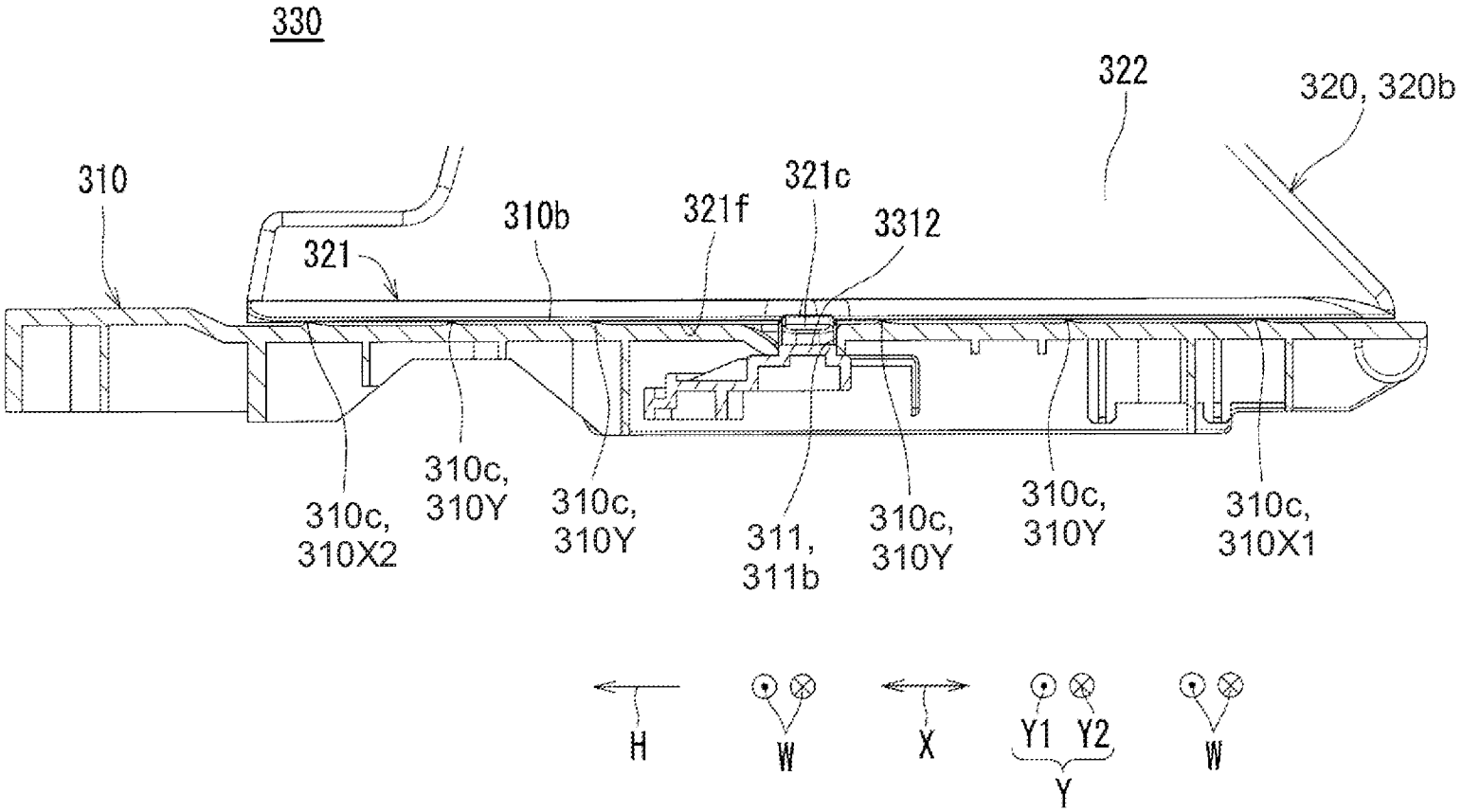
FIG. 13A is a cross-sectional view of the downstream document tray portion along A-A line shown in FIG. 11A.
Figure 13B:
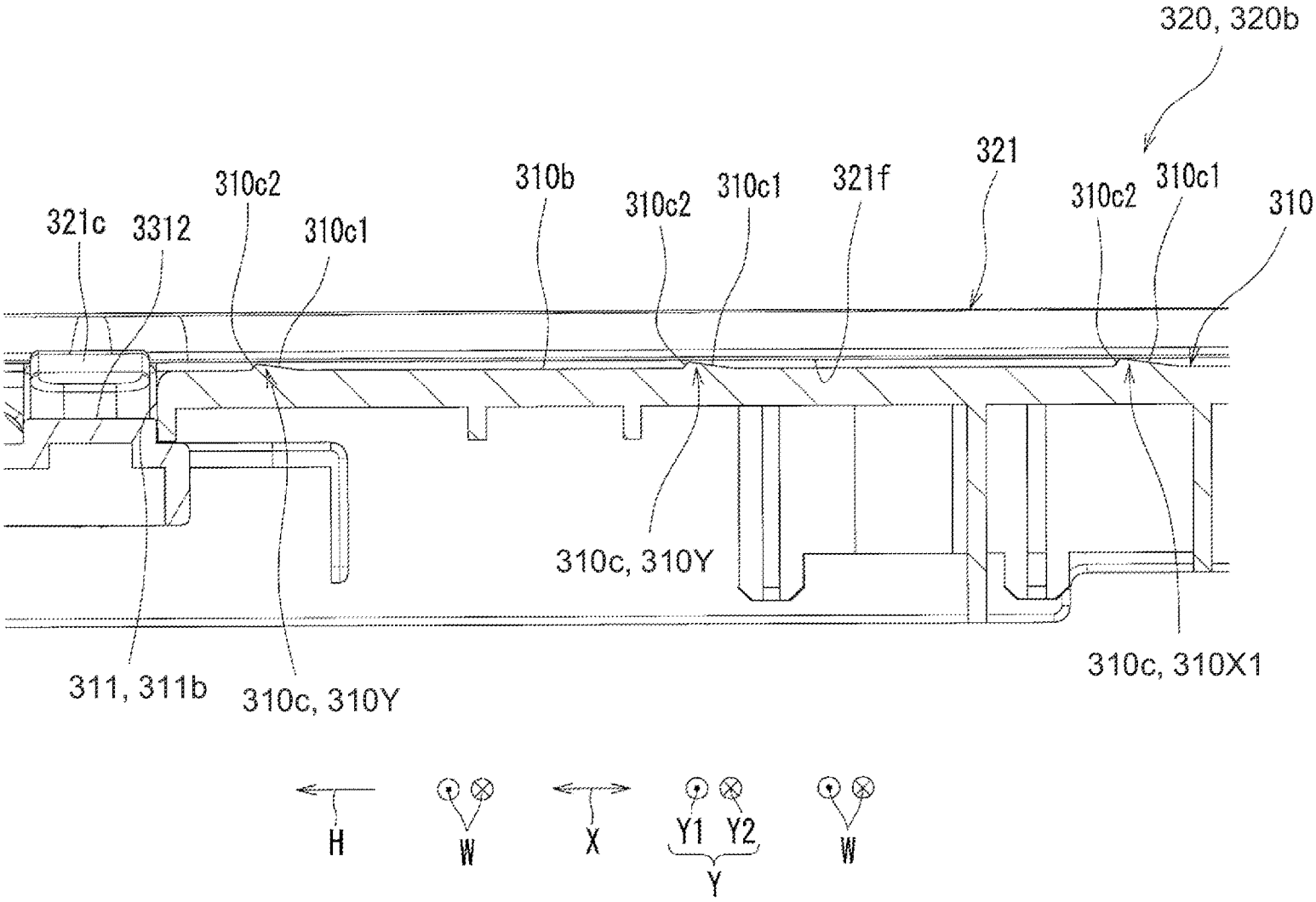
FIG. 13B is a cross-sectional view showing a convex portion upstream in the conveying direction from the scooper in FIG. 13A.
Figure 13C:
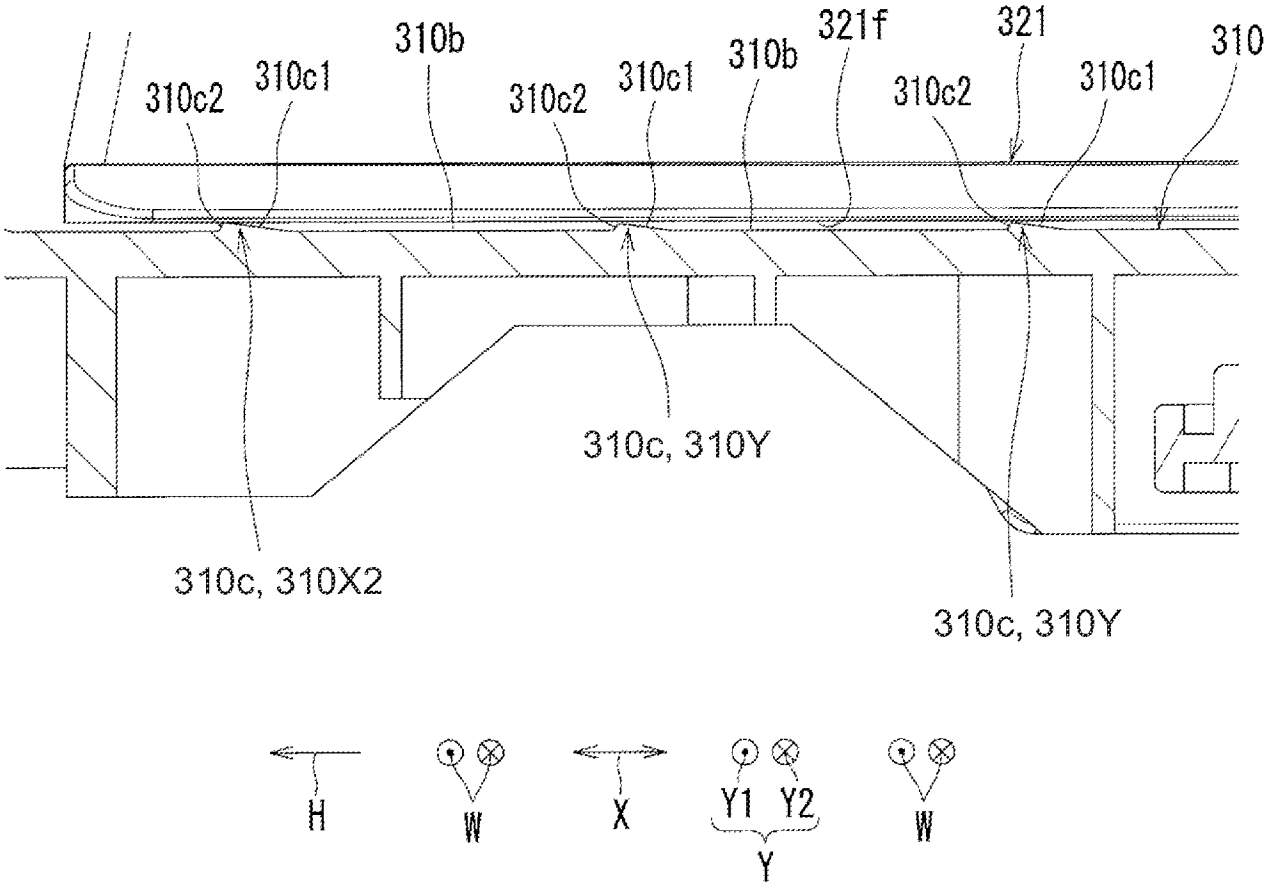
FIG. 13C is a cross-sectional view showing a convex portion downstream in the conveying direction from the scooper in FIG. 13A.

FIG. 13A is a cross-sectional view of the downstream document tray portion 330 along A-A line shown in FIG. 11A. FIGS. 13B and 13C are cross-sectional views showing the convex portions 310*c* to 310*c* upstream and downstream in the conveying direction H from the scooper 321*c* in FIG. 13A, respectively. FIGS. 13A to 13C show the convex portion 310*c* in the document guide 320*b* on the opposite side of the operation side, but the document guide 320*a* on the operation side has a similar configuration and is not shown here.

As shown in FIGS. 13A to 13C, the document tray 310 is provided with a plurality of convex portions 310*c* to 310*c* (ribs) extending in the width direction W.

By doing so, the contact area between the plurality of convex portions 310*c* to 310*c* at the document tray 310 and the lower face 321*f* of the document guide side document loader 321 in the document guide 320 (320*a*, 320*b*) can be made smaller, thereby enabling the document guide 320 (320*a*, 320*b*) to smoothly reciprocally move in the width direction W relative to the document tray 310.

Second Embodiment

By the way, in the case where a plurality of convex portions 310*c* to 310*c* are provided at the document tray 310, an operator may move the document G, which is loaded on the convex portions 310*c* to 310*c*, downstream in the conveying direction H and set the document G. In this case, if a face 310*c*1 on the upstream side in the convex portions 310*c* to 310*c* is formed perpendicular to the upper face 310*b* of the document tray 310, the document G is easily caught by the convex portions 310*c* to 310*c* when the operator moves the document G downstream in the conveying direction H. It is also conceivable that the operator moves the document G, which is loaded on the convex portions 310*c* to 310*c*, upstream in the conveying direction H. In this case, if a face 310*c*2 on the downstream side in the convex portions 310*c* to 310*c* is formed perpendicular to the upper face 310*b* of the document tray 310, the document G is easily caught by the convex portions when the operator moves the document G upstream in the conveying direction H. Since the direction in which the operator sets the document G is the downstream direction in the conveying direction H, it is preferable to move the document G downstream more smoothly than to move the document G upstream.

In this regard, in the present embodiment, the faces 310*c*1 and 310*c*2 on both sides in the conveying direction H of the plurality of convex portions 310*c* to 310*c* are inclined, and the face 310*c*1 on the upstream side is inclined more gently than the face 310*c*2 on the downstream side.

With this, even if the operator moves the document G, which is loaded on the plurality of convex portions 310*c* to 310*c*, downstream in the conveying direction H and sets the document G, the face 310*c*1 on the upstream side of the convex portions 310*c* to 310*c* is inclined thereby to suppress the document G from being caught by the convex portions 310*c* to 310*c* when the operator moves the document G downstream in the conveying direction H. This allows the operator to smoothly move the document G downstream in the conveying direction H. In addition, even if the operator moves the document G, which is loaded on the convex portions 310*c* to 310*c*, upstream in the conveying direction, the face 310*c*2 on the downstream side in the convex portions 310*c* to 310*c* is inclined thereby to suppress the document G from being caught by the convex portions 310*c* to 310*c* when the operator moves the document G upstream in the conveying direction H. This allows the operator to smoothly move the document G upstream in the conveying direction H. Moreover, the face 310*c*1 on the upstream side is more gently inclined than the face 310*c*2 on the downstream side, so that the document G can be moved downstream more smoothly than the document G can be moved upstream.

By the way, convex portions 310*c* (310X1) and 310*c* (310X2) positioned at both outside ends in the conveying direction H merely being present can bring about an effect of suppressing, as much as possible, the contact area between the convex portions 310*c* and 310*c* at the document tray 310 and the lower face 321*f* of the document guide side document loader 321 in the document guide 320 (320*a*, 320*b*). However, in this case, it is conceivable that when the operator moves the document guide 320 (320*a*, 320*b*) to the document G side while the document G is loaded between the convex portion 310*c* (310X1) most upstream and the convex portion 310*c* (310X2) most downstream in the conveying direction H, the document G may enter the lower side of the document guide side document loader 321 of the document guide 320 (320*a*, 320*b*).

In this regard, in the present embodiment, the height of the convex portions 310*c* (310X1), 310*c* (310X2) positioned at both outside ends in the conveying direction H, among the plurality of convex portions 310*c* to 310*c*, is higher than the height of the convex portions 310*c* (310Y) to 310*c* (310Y) positioned inside, in the conveying direction H, the convex portions 310*c* (310X1), 310*c* (310X2) positioned at both outside ends. In this example, the heights of the convex portions 310*c* (310X1), 310*c* (310X2), which are positioned at both outside ends, from the upper face 310*b* of the document tray 310 are the same, and are higher, by a predetermined distance (for example, about 0.8 mm), than the heights of the convex portions 310*c* (310Y) to 310*c* (310Y), which are positioned inside, from the upper face 310*b* of the document tray 310.

By doing so, the convex portions 310*c* (310X1), 310*c* (310X2) positioned at both outside ends can be made to have a contact with the lower face 321*f* of the document guide side document loader 321, while the convex portions 310*c* (310Y) to 310*c* (310Y) positioned inside can be made to have no contact with the lower face 321*f* of the document guide side document loader 321. This allows the contact area between the plurality of convex portions 310*c*-310*c* at the document tray 310 and the lower face 321*f* of the document guide side document loader 321 in the document guide 320 (320*a*, 320*b*) to be suppressed as much as possible. In addition, even if the operator moves the document guide 320 (320*a*, 320*b*) to the document G side while the document G is loaded between the convex portion 310*c* (310X1) on the upstream side and the convex portion 310*c* (310X2) on the downstream side in the conveying direction H, the convex portions 310*c* (310Y) to 310*c* (310Y) positioned inside can effectively prevent the document G from entering the lower side of the document guide side document loader 321 of the document guide 320 (320*a*, 320*b*).

Third Embodiment

Figure 14:
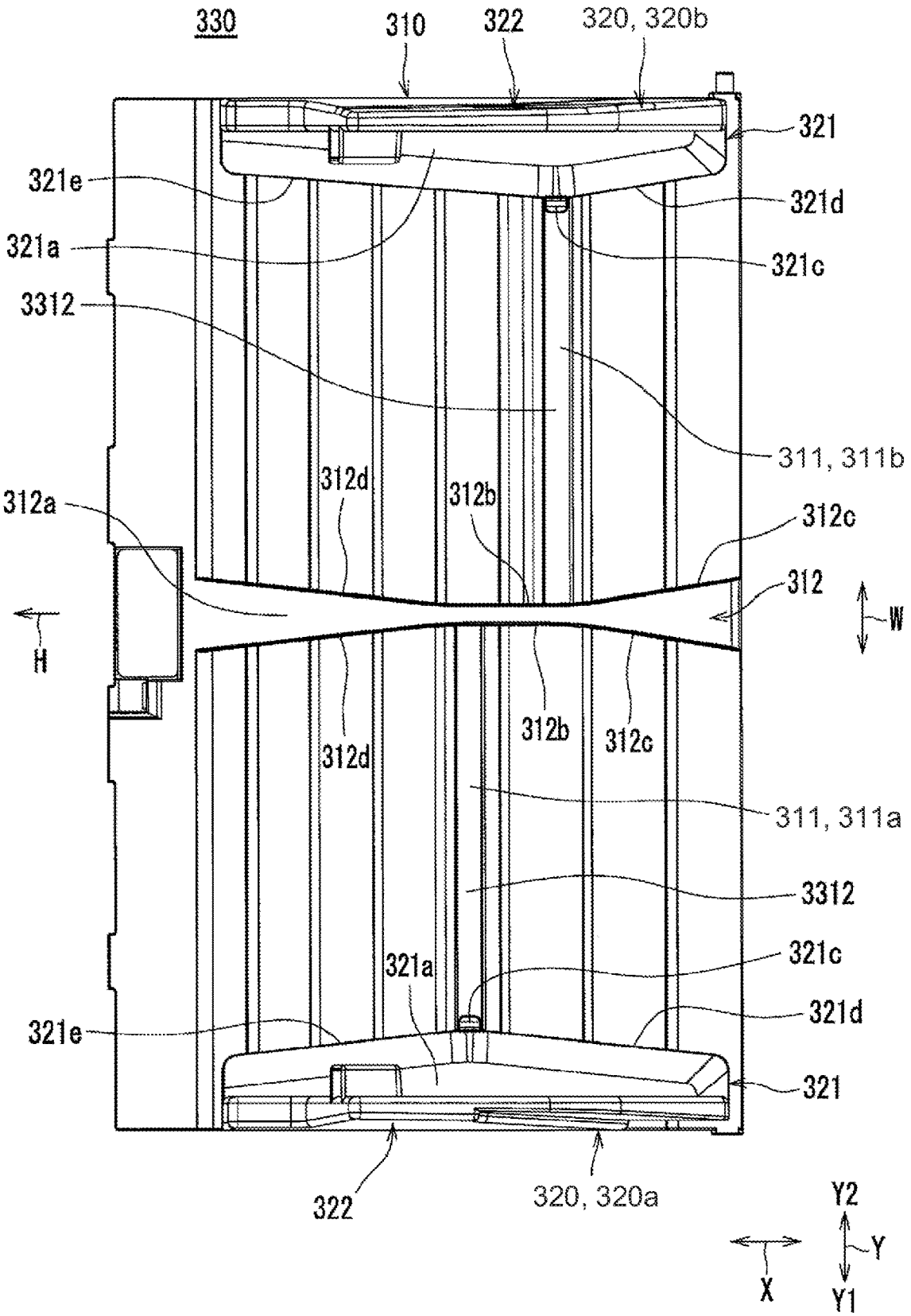
FIG. 14 is a plan view showing another example of the downstream document tray portion.

FIG. 14 is a plan view of another example of the downstream document tray portion 330.

As shown in FIG. 14, the scooper 321*c* in the document guide on the operation side (320*a* in this example) operated by the operator, among the pair of document guides 320*a* and 320*b*, is positioned downstream in the conveying direction H from the scooper 321*c* in the document guide on the opposite side of the operation side (320*b* in this example).

With this, even if the scooper 321*c* in the document guide (320*a*) on the operation side is positioned downstream in the conveying direction H from the scooper 321*c* in the document guide (320*b*) on the opposite side of the operation side, when the pair of document guides 320*a* and 320*b* are both moved inward in the width direction W, the document G can be securely scooped up by the scooper 321*c* in each of the pair of document guides 320*a* and 320*b*.

The present invention is not limited to the embodiments described above, and can be implemented in various other forms. Therefore, the embodiments are merely exemplifications in all respects and should not be interpreted to limit the present invention. The scope of the present invention is shown by the scope of claims and is not bound at all by the text of the specification. Further, all modifications and changes belonging to the equivalent scope of the claims are within the scope of the present invention.

What is claimed is:

1. A document feed device, comprising:

a document tray that loads a document; and a document guide that guides an end side of the document on at least one side of the document in a width direction orthogonal to a conveying direction of the document loaded on the document tray, wherein the document guide includes: a document guide side document loader that has a document loading face on which the document is loaded, and a document guide member that stands on the document guide side document loader and guides the end side of the document, the document tray includes a groove that extends along the width direction for a reciprocating movement of the document guide in the width direction, the document guide, at an end of the document guide side document loader in the width direction, includes: a scooper that scoops up the end side of the document when the document guide is moved toward the document loaded on the document tray, and an upstream outline portion that is formed so as to gradually approach the document guide member toward an upstream side in the conveying direction with the scooper as an apex, the document tray includes a plurality of convex portions extending in the width direction, and faces on both sides in the conveying direction of the plurality of the convex portions are inclined, and one of the faces on the upstream side is inclined more gently than another one of the faces on a downstream side.

2. An image forming device comprising: the document feed device according to claim 1.

3. A document feed device, comprising:

a document tray that loads a document; and a document guide that guides an end side of the document on at least one side of the document in a width direction orthogonal to a conveying direction of the document loaded on the document tray, wherein the document guide includes: a document guide side document loader that has a document loading face on which the document is loaded, and a document guide member that stands on the document guide side document loader and guides the end side of the document, the document tray includes a groove that extends along the width direction for a reciprocating movement of the document guide in the width direction, the document guide, at an end of the document guide side document loader in the width direction, includes: a scooper that scoops up the end side of the document when the document guide is moved toward the document loaded on the document tray, and an upstream outline portion that is formed so as to gradually approach the document guide member toward an upstream side in the conveying direction with the scooper as an apex, the document tray includes a plurality of convex portions extending in the width direction, and a height of a first set of the plurality of convex portions positioned at both outside ends in the conveying direction is higher than a height of a second set of the plurality of convex portions positioned inside in the conveying direction.

4. An image forming device comprising: the document feed device according to claim 3.

* * * * *